US005329343A

United States Patent [19]

Saito

[11] Patent Number: 5,329,343

[45] Date of Patent: Jul. 12, 1994

[54] TEMPERATURE CONTROL METHOD AND FIXING APPARATUS

[75] Inventor: Hideo Saito, Ebina, Japan

[73] Assignee: Fuji Xerox Co., Ltd., Tokyo, Japan

[21] Appl. No.: 883,459

[22] Filed: May 14, 1992

[30] Foreign Application Priority Data

May 14, 1991 [JP] Japan ..... 3-137066

[51] Int. Cl.[5] ..... G03G 15/20

[52] U.S. Cl. ..... 355/290; 219/216; 355/285

[58] Field of Search ..... 355/208, 282, 285, 289, 355/290; 219/216, 469

[56] References Cited

U.S. PATENT DOCUMENTS

| | | | |
|---|---|---|---|
| 4,163,892 | 8/1979 | Komatsu et al. | 219/216 |
| 4,549,803 | 10/1985 | Ohno et al. | 219/216 X |
| 4,737,818 | 4/1988 | Tanaka et al. | 219/216 X |
| 4,905,051 | 2/1990 | Satoh et al. | 355/290 |
| 4,920,250 | 4/1990 | Urban | 219/216 |
| 4,977,431 | 12/1990 | Fuji | 355/289 |
| 5,051,780 | 9/1991 | Stelter et al. | 355/208 |

FOREIGN PATENT DOCUMENTS

| | | | |
|---|---|---|---|
| 58-14870 | 1/1983 | Japan . | |
| 0087575 | 5/1983 | Japan | 355/208 |
| 59-28178 | 2/1984 | Japan . | |
| 0150075 | 8/1985 | Japan | 355/290 |
| 0285483 | 12/1986 | Japan | 355/208 |
| 2-110588 | 4/1990 | Japan . | |

*Primary Examiner*—A. T. Grimley
*Assistant Examiner*—Robert Beatty
*Attorney, Agent, or Firm*—Finnegan, Henderson, Farabow, Garrett & Dunner

[57] ABSTRACT

A temperature control method and apparatus for a fixing apparatus, in which a first roll contacting the back surface of a recording sheet and a second roll contacting the front surface of a recording sheet for fixing a recording sheet carrying a toner image are individually equipped with heating mechanism. The temperature control method and apparatus can suppress storage of the rolls with wasteful thermal energy to fix with less thermal energy. For this suppression, a target surface temperature y required for the second roll to reproduce a predetermined fixing property is computed from an actually measured temperature value X of the first roll so that only one of the heating means is driven on the basis of the result of comparison between the target surface temperature y and an actually measured temperature value Y of the second roll.

29 Claims, 15 Drawing Sheets

TEMPERATURE CONTROL METHOD AND FIXING APPARATUS

BACKGROUND OF THE INVENTION

1. Field of the Invention

The present invention relates to a temperature control method for use in a fixing apparatus for thermally fixing a toner image onto a recording sheet of a copying machine or printer and, more particularly, to a temperature control method for a fixing apparatus in which a pair of rolls abut against the front and back of the recording sheet and are individually equipped with heaters.

2. Description of Related Art

In most of the fixing apparatus of this kind in the prior art, the heater is packaged in only that one of the paired rolls to be brought into abutment against the front surface of the recording sheet carrying a toner image thereon. Moreover, the temperature control of the heater is always adjusted to a target value of the surface temperature of the roll by setting a certain target temperature in advance and by energizing the heater only when the surface temperature of the roll having the heater packaged therein becomes lower than the target value.

In the so-called "full-color copying machine", however, an unfixed toner image is formed by overlapping toners of four colors of Cyan, Magenta, Yellow and Black. If, therefore, the unfixed toner image is heated only from the front side of the recording sheet, there arises a problem that the fixing property is deteriorated because sufficient thermal energy will not propagate to the toner of the lowermost layer contacting with the recording sheet. On the other hand, the full-color recorded image itself requires more sufficient thermal energy to be applied to the toners than a monochromatic recorded image, if its coloring property is considered.

For use in the full-color copying machine or the like, therefore, there has been proposed in recent years a fixing apparatus which is equipped with a heater even in the roll to be brought into abutment against the back side of the recording sheet.

However, this fixing apparatus having the individual heaters in the rolls abutting against the front and back sides of the recording sheet has to consider as its important problem how the temperatures of the individual rolls are to be controlled. This is because the copying machine or printer, in which the fixing apparatus of that kind is to be packaged, is designed premising that it is used with the home-service power supply of 100 V, so that the simultaneous energizations of the two heaters cannot be achieved because of the restrictions on the rated current. Thus, what can be energized is only one heater. The specific temperature control methods proposed in the prior art will be described in the following together with their problems.

In a first method, two rolls are individually set with target temperatures so that one of the roll has its heater energized if its surface temperature only is lower than the target value or so that the two rolls have their individual heaters energized alternately for a constant time period if both their surface temperatures are lower than the target values.

However, the efficiency for the rolls abutting against the front and back sides of the recording sheet to contribute to the fixing of the unfixed toner image, that is, the thermal energies for the individual rolls to be applied to the toners for a constant time period are naturally higher at the front-side roll contacting directly with the unfixed toner image than at the back-side roll. In case, therefore, the roll is liable to have its surface temperature seriously dropping as in the continuous copying operation, the thermal energy to be stored in the individual rolls could be more efficiently used if the heater of the front-side roll were preferentially energized. In this connection, according to this control method, an equal quantity of thermal energy is applied to the rolls abutting against the front and back sides of the recording sheet so that an excess thermal energy has a tendency to be stored in the roll abutting against the back side. Thus, this method is accompanied by a problem that the restricted thermal energy cannot be efficiently used.

In view of the problems of the first method, there has been proposed a second method, in which the heater of the front-side roll is preferentially energized if both the surface temperatures of the two rolls are lower than the target values. In other words, the heater of the back-side roll is not energized so long as the surface temperature of the front-side roll fails to reach the target value.

In the fixing device having both its front- and back-side rolls equipped with the heaters, however, a sufficient fixing property might be achieved if the surface temperature of the back-side roll were at a considerably high level although that of the front-side roll were lower than the target value. According to this control method, therefore, the energy efficiency is seriously deteriorated because the front roll is heated more than necessary.

Since, moreover, the surface temperatures of the rolls could not reach the target values if in the continuous copying operations, according to this control method, the heater of the front-side roll is kept energized once the copying operations are started, till the copying operations are ended so that the surface temperature of the front-side roll restores its target value. As a result, this method is troubled by a problem that the temperature in the inside of the front-side roll rises to a level higher by about 50° C. than the target value till the heater is turned off, thus causing the so-called "overshoot phenomenon", in which the surface temperatures of the rolls exceed the target values by 20° C. to 30° C.

Incidentally, the fixing apparatus of the prior art is equipped with control means for deciding the incapability of the fixing operation in relation to the temperature control of the rolls having the heaters, if the roll surface temperatures drop to levels lower than the lowest fixing temperature determined in advance. In the fixing apparatus, however, which is equipped with the individual heaters in the rolls to be brought into the front and back of the recording sheet, as has been described hereinbefore, the lowest temperature required for the front-side roll to reproduce the predetermined fixing property would change with a change in the surface temperature of the backside roll. It would, therefore, be seriously diadvantageous to decide the capability of the fixing operation in terms of the lowest constant fixing temperature, as in the prior art. Specifically, the actually capable state of the fixing operation might be misjudged to be incapable, or vice versa. Thus, it has been impossible to avoid the reduction in the operating efficiency of the apparatus and the deterioration of the image fixing property.

Thus, in the temperature control methods of the prior art, the wasteful thermal energies having no contribution to the fixing of the unfixed toner image are stored in the individual rolls to deteriorate the energy efficiency, and still the worse the apparatus itself is adversely affected by the overshoot phenomenon. Moreover, the decision of the capability of the fixing operation is not accurate to deteriorate the operating efficiency of the copying machine or printer and the reliability of the fixing operation.

OBJECTS AND SUMMARY OF THE INVENTION

The present invention has been conceived in view of the problems thus far described and has a first object to provide both a temperature control method for a fixing apparatus, which can suppress the storage of the rolls with the wasteful thermal energy having no contribution to the fixing operation thereby to accomplish a satisfactory fixing operation with less thermal energy.

A second object of the present invention is to provide a temperature control method for a fixing apparatus, which can decide the capability of the fixing operation accurately to improve the operating efficiency and the reliability.

In order to achieve the above-specified objects, the preferred embodiments of the present invention include four temperature control methods for a fixing apparatus and four fixing apparatus for practicing those methods.

DESCRIPTION OF THE PREFERRED EMBODIMENTS

Figure 1:
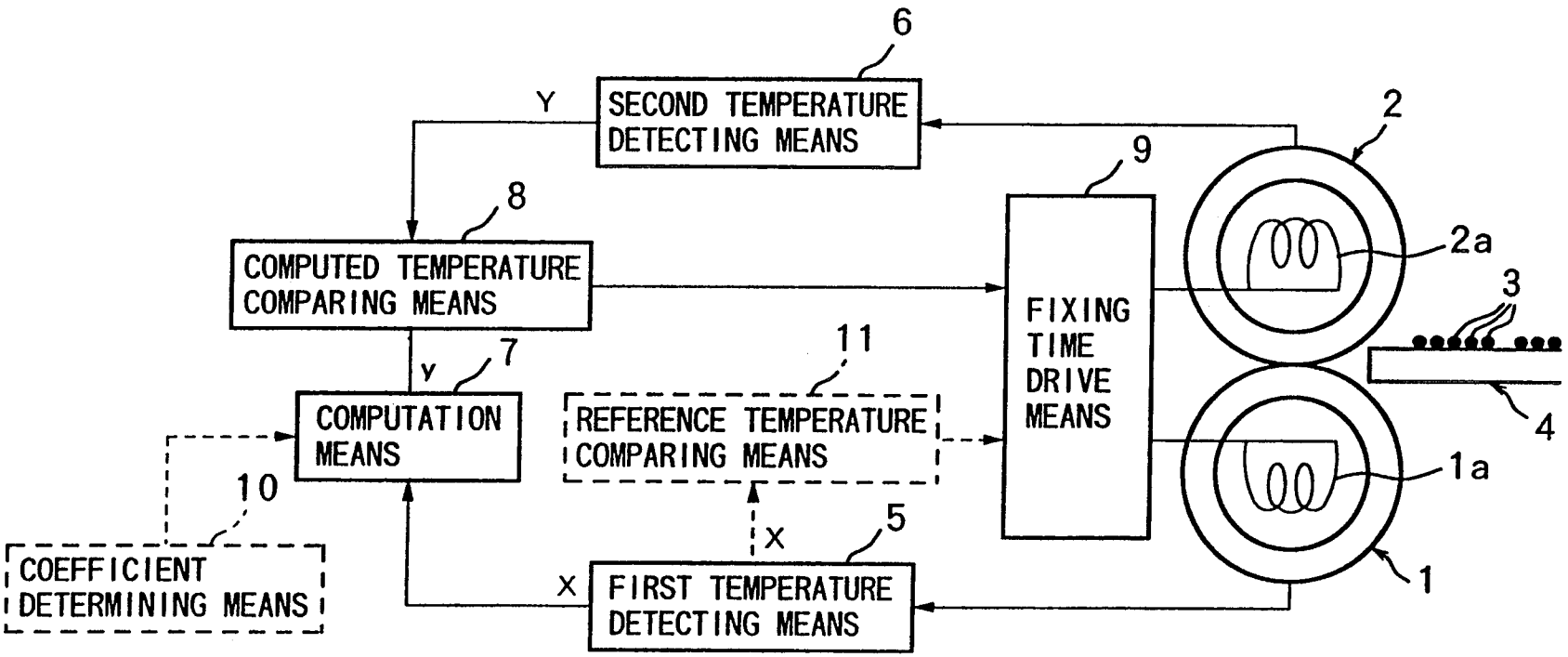
FIG. 1 is a diagram showing a basic structure of a fixing apparatus according to the first temperature control method of the present invention.

First, there is provided a first temperature control method for a fixing apparatus including a first roll having first heating means therein, and a second roll arranged to abut against the first roll and having second heating means therein, for thermally fixing a toner image onto a recording sheet fed from an image forming device. The temperature control method comprises an image fixing mode to be executed in the imaging operation of the image forming device. The image fixing mode comprises: a computing step of computing a target surface temperature y required for the second roll to reproduce a predetermined fixing property from an actually measured temperature value X of the first roll; a computed temperature comparing step of comparing the target surface temperature y and an actually measured temperature value Y of the second roll; and a fixing time control step of driving the first heating means or the second heating means on the basis of the result of comparison.

A fixing apparatus for practicing this method is used for thermally fixing a toner image 3 onto a recording sheet 4 fed from an image forming device (although not shown) comprises: a first roll 1 having first heating means 1*a* therein; a second roll 2 having second heating means 2*a* therein; first temperature detecting means 5 for detecting the surface temperature of the first roll 1; second temperature detecting means 6 for detecting the surface temperature of the second roll 2; and control means for controlling the first heating means 1*a* and the second heating means 2*a*. The control means includes image fixing mode executing means for functioning during the imaging operation of the image forming device. The image fixing mode executing means includes: computation means 7 for computing a target surface temperature y required for the second roll 2 to reproduce a predetermined fixing property from the temperature value X of the first roll 1, which is actually detected by the first temperature detecting means 5; computed temperature comparing means 8 for comparing the target surface temperature y and the temperature value Y of the second roll 2, which is actually detected by the second temperature detecting means 6; and fixing time drive means 9 for driving the first heating means 1*a* or the second heating means 2*a* on the basis of the result of comparison.

In the fixing apparatus, to which the present invention is applied, the first roll and the second roll to abut against the front and back of the recording sheet are individually equipped with the heating means so that the fixing property of the toner image on the recording sheet is determined by the correlation of the surface temperatures of the two rolls. Specifically, the same fixing property as that before the temperature change can be retained if the surface temperature of the second roll rises to such a level as to compensate for the drop, if any, of the surface temperature of the first roll. If the first roll has a surface temperature x, a surface temperature y required for the second roll to reproduce a constant fixing property is expressed by a fixing characteristic formula of $y=f(x)$ having a variable x.

In the image fixing mode of the method of the present invention, therefore, a target surface temperature $y=f(X)$ required for the second roll to reproduce a predetermined fixing property is computed from an actually measured surface temperature X of the first roll, and this target surface temperature y and an actually measured surface temperature Y are compared. If the actually measured surface temperature Y of the second roll is lower than the aforementioned target surface temperature y (i.e., $Y<y$), either the first heating means packaged in the first roll or the second heating means packaged in the second roll is driven so that the actually measured temperature value Y may exceed its target surface temperature y (i.e., $Y\geqq y$).

Since, at this time, the actually measured temperature value Y of the second roll will rise if the second heating means is driven, the relation of $Y\geqq y$ can naturally be achieved. In the present invention, however, the same result could be achieved even if the first heating means were driven. This is because the target surface temperature of the second roll to be computed from the actually measured temperature value X of the first roll will drop if the value X rises. Since, however, the roll contacting with the front side of the recording sheet will give more thermal energy to the toner image than the roll contacting with the back side of the recording sheet, it is more preferable for the energy efficiency to heat the roll contacting with the front side of the recording sheet, so that the relation of $Y\geqq y$ can be obtained for a shorter time period.

Incidentally, FIG. 1 shows a structure, in which the second roll 2 contacts with the front side of the recording sheet 4, but this structure may be modified such that the first roll 1 contacts with the front side of the recording sheet 4.

Figure 5:
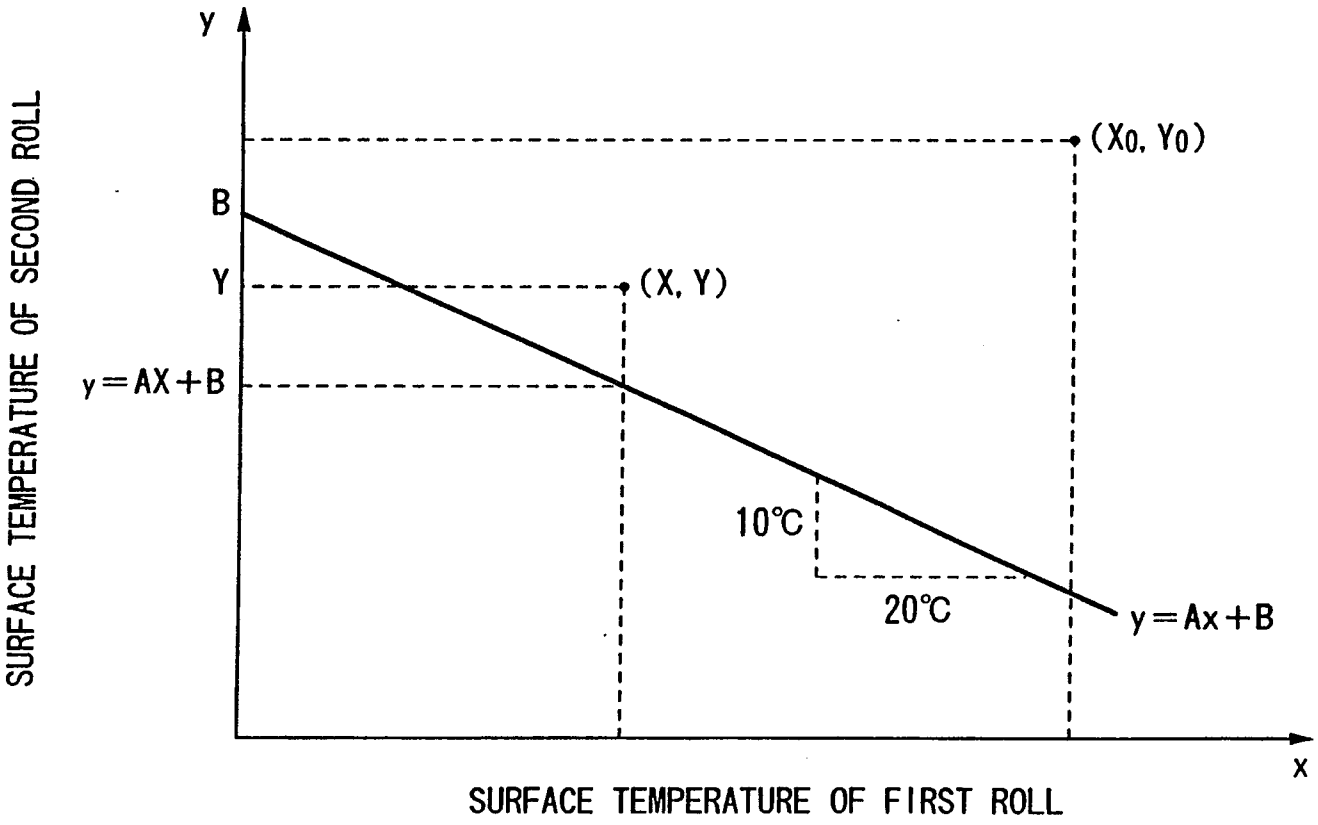
FIG. 5 is a graph illustrating the aforementioned first temperature control method.

In order to define the aforementioned fixing characteristic formula of $y=f(x)$, we have measured a number of combinations (x, y) of the surface temperature x of the first roll and the surface temperature y of the second roll, so that the toner image exhibits an identical fixing property, and have plotted those measured values in a graphical form by using a coordinate system having its abscissa indicating the surface temperature x of the first roll and its ordinate indicating the surface temperature y of the second roll. As a result, we have been able to achieve a linear graph of $y=Ax+B$, as shown in FIG. 5. In the embodiments of the present invention to be described hereinafter, therefore, the target surface temperature y of the second roll is computed by using the fixing characteristic formula: $y=Ax+B$.

In this fixing characteristic formula, the coefficient A designates the ratio of efficiencies for the first roll and the second roll to contribute to the fixing of the toner image. If, for example, the same fixing property is retained by raising the surface temperature y of the second roll to 10° C. when the surface temperature x of the first roll drops by 20° C., as shown in FIG. 5, the aforementioned coefficient A takes a value of $-\frac{1}{2}$. In case the first roll contacts with the back side of the recording sheet, the coefficient A is thought to have a value of about $-\frac{1}{2}$ to $-\frac{1}{3}$, which is more or less different depending upon differences in the materials and structures of the individual rolls. As a result, the coefficient A takes different values for different fixing apparatus and can be experimentally determined by confirming the fixing properties of the toner images successively when the combinations (x,y) of the surface temperature of the individual rolls are arbitrarily varied.

On the other hand, the coefficient B indicates the degree of the fixing property of the toner image and can be selected at will in accordance with the fixing property required. Specifically, the target temperature value of $y=AX+B$ of the second roll, which is computed by using the actually measured temperature value X of the first roll, takes a large value, if the coefficient B is set to a large value, so that the total amount of thermal energy to be fed to the toner image from the first roll and the second roll increases to improve the fixing property of the toner image. If the coefficient B is set to a small value, on the contrary, the target temperature value $y=AX+B$ of the second roll takes a small value so that the total amount of thermal energy to be fed to the toner image from the first roll and the second roll decreases to deteriorate the fixing property of the toner image.

The total amount of the thermal energy required for fixing the toner image is different depending upon the imaging operation of the image forming device such as a copying machine or printer. A larger-sized recording sheet requires a larger total amount of thermal energy necessary for the fixing operation than a smaller-sized recording sheet, and a color toner image requires a larger total amount of thermal energy neccessary for the fixing operation than a monochromatic toner image. Thus, the aforementioned coefficient B is preferably selected at each imaging operation of the image forming device. As shown in FIG. 1, a specific device is equipped with coefficient determining means 10, which is stored in advance with a plurality of coefficients $B_1$, $B_2$, $B_3$, - - - , and so on corresponding to the various imaging operations of the image forming device, so that a specific coefficient $B_N$ may be fed to the computation means in accordance with the data of the imaging operation inputted from the CPU of the image forming device.

In the image fixing mode proposed by this first method, the predetermined fixing property determined by the aforementioned coefficient B is reproduced on the recording sheet if the actually measured temperature value Y of the second roll is larger than the target surface temperature $y=AC+B$ computed by using the actually measured temperature value X of the first roll (i.e., $Y\geqq y$). Thus, neither the first heating means not the second heating means need not be driven. If, therefore, the second roll is hot, the relation of $Y\geqq y$ holds even if the actually measured temperature value X of the first roll is extremely low, so that none of the heating means is driven. If, however, the fixing operation of the toner image is executed in that temperature state, much thermal energy is lost from the second roll because the thermal energy to be fed from the first roll to the recording sheet, thus causing a trouble that the surface temperature of the second roll seriously drops. If, in this temperature state, the actually measured temperature value Y gets lower than the target surface temperature y (i.e., $Y<$), the second heating means might be driven to raise the temperature of the second roll to an excessively high level, thus inviting a danger of the overshoot phenomenon.

In this image fixing mode, therefore, a reference temperature comparing step of comparing an arbitrarily determined reference temperature value $X_1$ of the first roll and the aforementioned actually measured temperature value X of the first roll is preferably provided to drive the first heating means even for $Y\geqq y$, if the result of comparison by the reference temperature comparing step is $X<X_1$, to restore the surface temperature of the first roll to the reference temperature value $X_1$ or higher. As shown by broken lines in FIG. 1, the specific apparatus is newly equipped with reference temperature comparing means 11 so that the aforementioned fixing time drive means 9 may drive the first heating means 1*a* on the basis of the result of comparison of the reference temperature comparing means 11.

According to this first temperature control method, the energization control of each heating means 1*a* or 2*a* during the imaging operation of the image forming device is executed on the basis of the fixing characteristic formula which was experimentally deduced. As a result, if the surface temperature of the first roll is high to some extent, the energization of the second heating means packaged in the second roll may be interrupted even if the surface temperature of the second roll is low. Thus, there arises an advantage that any excess thermal energy need not be fed to each roll. Since, moreover, whether or not the heating means is energized is determined in the correlation of the surface temperatures of the two rolls, the energization to each heating means can be interrupted even during the fixing operation, in which the surface temperature of the roll is liable to drop. As a result, it is possible to effectively prevent the overshoot phenomenon in each roll 1 or 2. Another advantage is that a constant fixing property expressed by the fixing characteristic formula can be warranted for the toner image fixed on the recording sheet.

The first temperature control method thus far described according to the present invention relates to the image fixing mode for the imaging operation of the image forming device and provides the means which is effective when the first heating means and the second heating means cannot be simultaneously driven due to the restriction on the rated current. However, if the image forming device is not in its imaging operation, e.g., in the standby state of the copying machine or at the initial rise of the main power supply, the first heating means and the second heating means could be simultaneously driven because the power consumption other than at the fixing apparatus is a little. In this case, therefore, both the first heating means and the second means can be driven together to store more thermal energy in the individual rolls thereby to stabilize the subsequent fixing operation. At the initial stage when the main power is supplied to the copying machine, moreover, the copying operation cannot be executed before the individual rolls of the fixing apparatus reach their predetermined temperatures. Thus, there arises an advantage that the standby time period can be shortened by energizing the heating means of the individual rolls simultaneously.

Thus, a second temperature control method according to the present invention comprises: a standby mode to be executed during an imaging standby of the image forming device; and an image fixing mode to be executed in the imaging operation of the image forming device. The standby mode comprises: a first fixed temperature comparing step of comparing an arbitrarily determined standby surface temperature $X_o$ of the first roll and an actually measured temperature value X of the first roll; a second fixed temperature comparing step of comparing an arbitrarily determined standby surface temperature $Y_o$ of the second roll and an actually measured temperature value Y of the second roll; a first roll control step of driving the first heating means on the basis of the result of comparison of the first fixed temperature comparing step; and a second roll control step of driving the second heating means on the basis of the result of comparison of the second fixed temperature comparing step.

Figure 2:
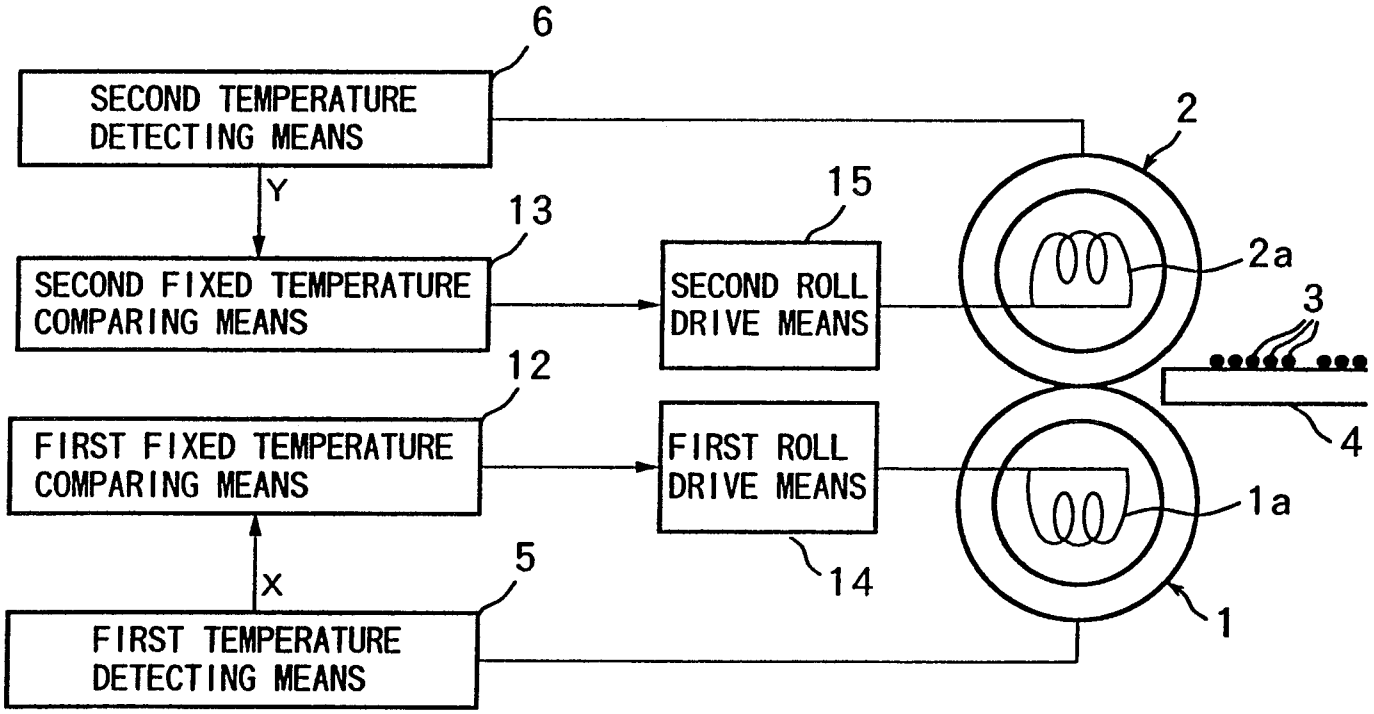
FIG. 2 is a diagram showing a basic structure of a fixing apparatus according to the second temperature control method of the present invention.

In an apparatus for practicing this method, moreover, the control means for controlling the first heating means and the second heating means includes: standby mode executing means for functioning during the imaging standby of the image forming device; and image fixing mode executing means for functioning during the imaging operation of the image forming device. As shown in FIG. 2, the standby mode executing means includes: first fixed temperature comparing means 12 for comparing an arbitrarily determined standby surface temperature $X_o$ of the first roll 1 and an actually measured temperature value X of the first roll 1; second fixed temperature comparing means 13 for comparing an arbitrarily determined standby surface temperature $Y_o$ of the second roll 2 and an actually measured temperature value Y of the second roll 2; first roll control means 14 for driving the first heating means 1*a* on the basis of the result of comparison of the first fixed temperature comparing means 12; and second roll control means 18 for driving the second heating means 2*a* on the basis of the result of comparison of the second fixed temperature comparing means 13.

In this standby mode, the drive of the first heating means is determined exclusively from the relation between the levels of the actually measured temperature value X and the standby surface temperature $X_o$ of the first roll, and the drive of the second heating means is determined exclusively from the relation between the levels of the actually measured temperature value Y and the standby surface temperature $Y_o$ of the second roll. Thus, depending upon the actually measured temperature values (X, Y) of the individual rolls, the two heating means are simultaneously driven to make such a control at all times that the actually measured temperature values (X, Y) of the individual rolls may be led for the shortest time to the standby surface temperature ($X_o$, $Y_o$).

This standby surface temperature ($X_o$, $Y_o$) to be used is one capable of sufficiently reproducing the fixing property of the toner image to be scheduled in the aforementioned image fixing mode, as shown in FIG. 5. As a result, the comparison between the target surface temperature $y=f(X_o)$ of the second roll, which was computed by using the standby surface temperature $X_o$ of the first roll, and the standby surface temperature $Y_o$ of the second roll naturally produces the result of $Y_o \geqq y=f(X_o)$.

Figure 6:
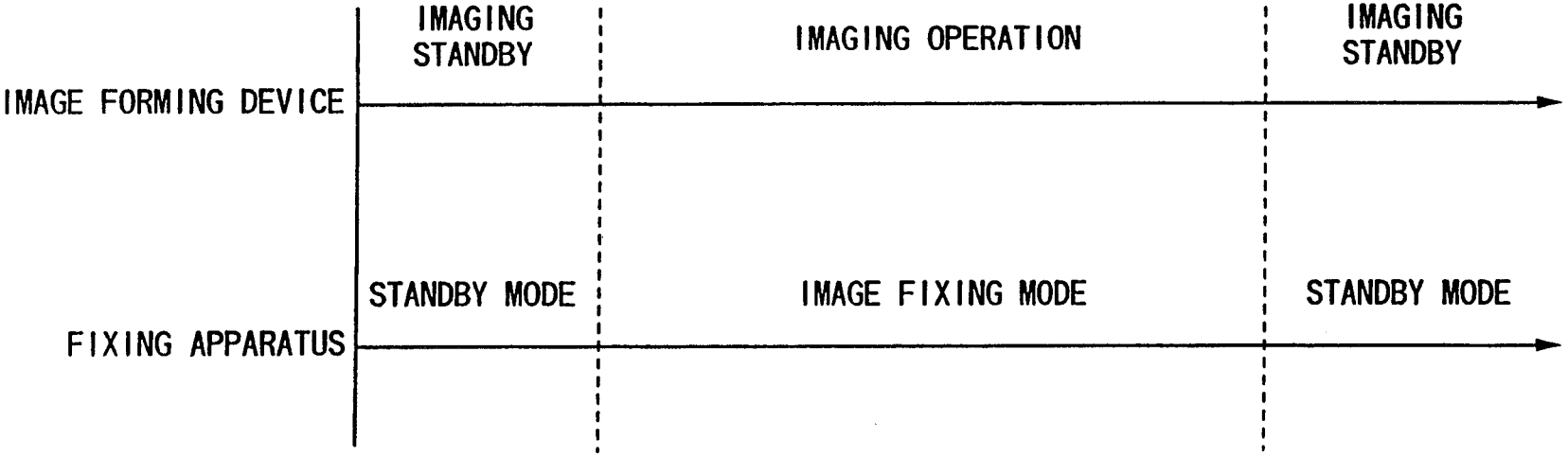
FIG. 6 is a timing chart showing the relations between the aforementioned second temperature control method and the operating states of the image forming device.

FIG. 6 is a timing chart showing the correspondences between the imaging operations of the image forming device and the individual modes. Since the two heating means cannot be simultaneously driven during the imaging operation of the image forming device, according to the second temperature control method, the standby mode is ended at the start of the imaging operation of the image forming device, and the image fixing mode is then executed. Moreover, the switching from the image fixing mode to the standby mode may be accomplished, as shown in FIG. 6, either in synchronism with the end of the imaging operation of the image forming device or at a predetermined timing from the end of the imaging operation.

Figure 7:
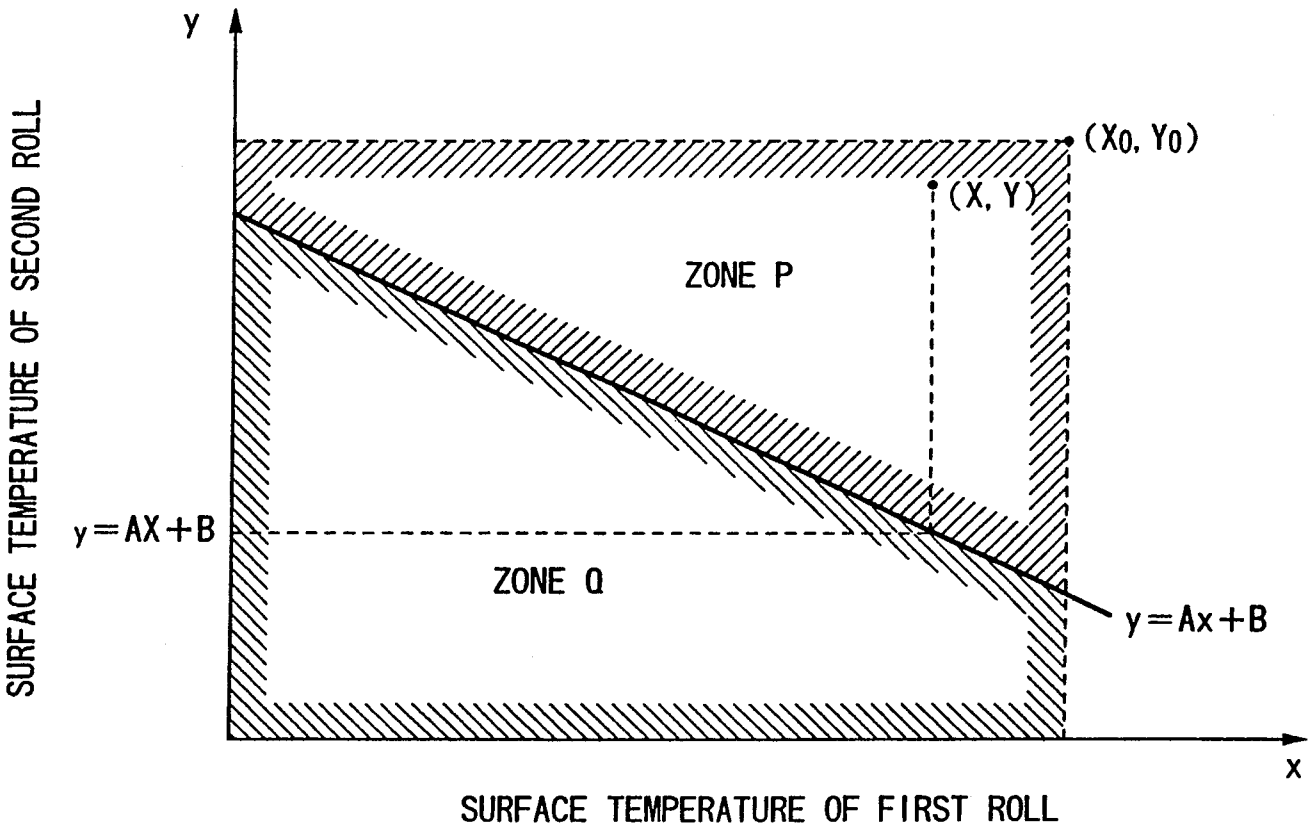
FIG. 7 is a graph illustrating the aforementioned second temperature control method.

Incidentally, in this second temperature control method, sufficient thermal energy is stored in the individual rolls during the standby mode so that the initial stage of the start of the image fixing mode involves a time period, for which neither the first heating means not the second heating means is driven. This reason will be described in the following. Since, in the standby mode, the actually measured temperature values (X, Y) of the individual rolls are controlled to conform to the standby surface temperature ($X_o$, $Y_o$), the actually measured temperature values (X, Y) of the individual rolls are thought to lie in the vicinity of the standby surface temperature ($X_o$, $Y_o$) just at the end of the standby mode, as shown in FIG. 7, so that the target surface temperature y of the second roll computed in the image fixing mode is naturally lower than the actually measured temperature value Y of the second roll. As a result, when the mode is switched from the standby mode to the image fixing mode, neither the first heating means nor the second heating means is driven so long as the actually measured temperature values (X, Y) of the individual rolls do not move from a zone P to a zone Q, as shown in FIG. 7.

When, however, the imaging operation is started in the image forming device, the thermal energies of the individual rolls are consumed by the fixing operation of the toner image so that the actually measured temperature values (X, Y) of the individual rolls are abruptly moved from the zone P to the zone Q. For reproducing a predetermined fixing property, as has already been described, it is important that the actually measured temperature values (X, Y) of the individual rolls exist in the zone P. According to this second temperature control method, therefore, the fixing property of the toner image may be possibly deteriorated at an early stage for a number of continuous copies.

Therefore, a third temperature control method of the present invention comprises: the standby mode; the image fixing mode; and a shift mode to be executed, if necessary, at the initial stage of the imaging start of the image forming device. The shift mode comprises: the first fixed temperature comparing step; the second fixed temperature comparing step; and a shifting time control step of driving the first heating means or the second heating means on the basis of the results of comparison of the first fixed temperature comparing step and the second fixed temperature comparing step.

Figure 3:
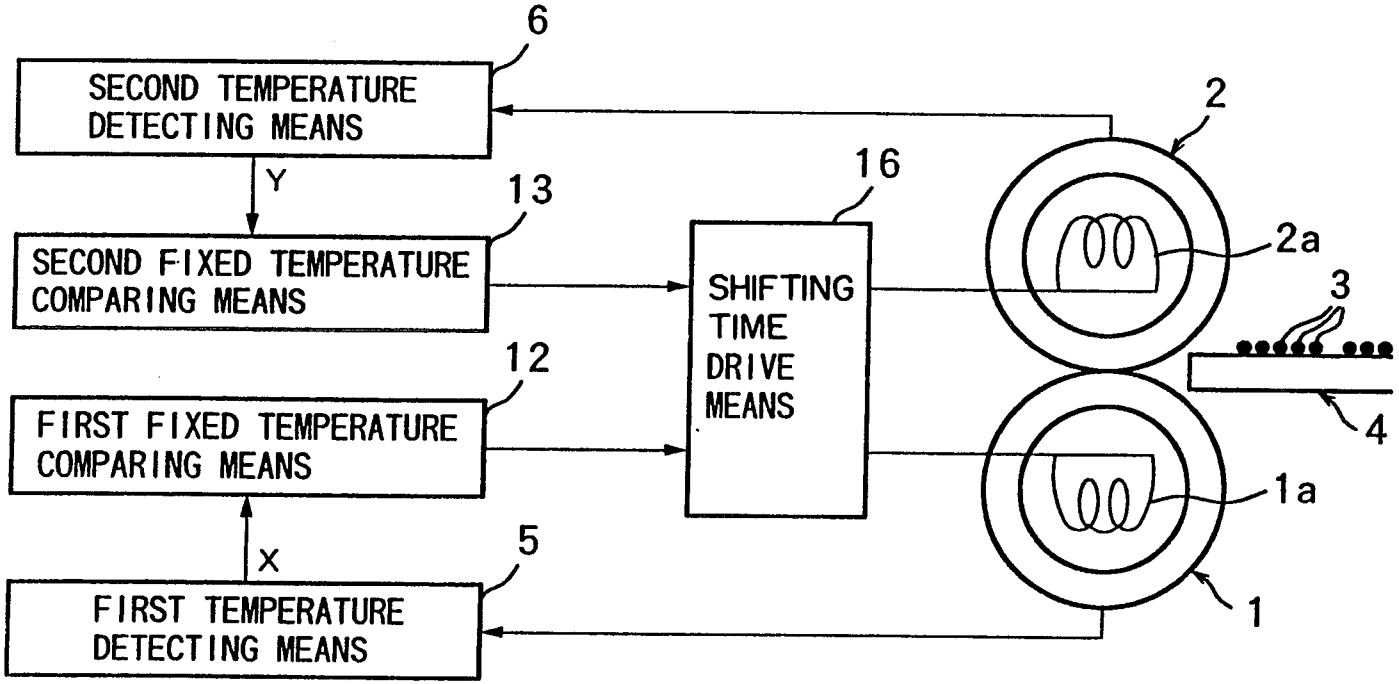
FIG. 3 is a diagram showing a basic structure of a fixing apparatus according to the third temperature control method of the present invention.
Figure 4:
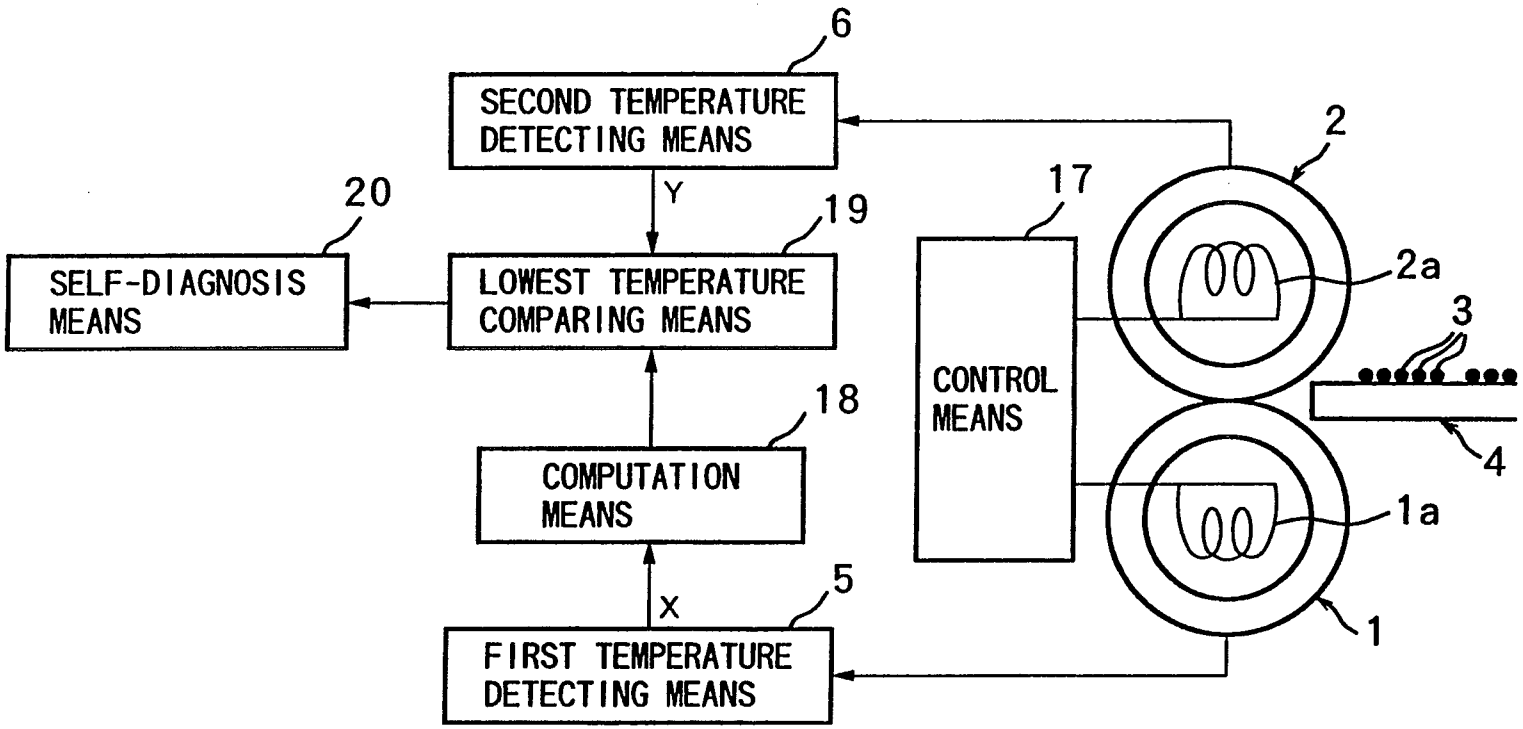
FIG. 4 is a diagram showing a basic structure of a fixing apparatus according to the fourth temperature control method of the present invention.

In an apparatus for practicing this method, moreover, the control means for controlling the first heating means and the second heating means includes: the standby mode executing means; the image fixing mode executing means; and shift mode executing means for functioning, if necessary, only at the initial stage of the imaging start of the image forming device. As shown in FIG. 3, the shift mode executing means includes: the first fixed temperature-comparing means 12; the second fixed temperature comparing means 13; and shifting time drive means 16 for driving the first heating means 1*a* or the second heating means 2*a* on the basis of the results of comparison between the first fixed temperature comparing means 12 and the second fixed temperature comparing means 13.

The difference between the aforementioned shift mode and the aforementioned standby mode resides in whether or not the first heating means and the second heating means are simultaneously driven. Since, in the shift mode, the aforementioned image forming device has already started its imaging operation, the first heating means and the second heating means cannot be simultaneously driven. As a result, only one of the drive means is driven even if the result of comparison between the actually measured temperature values (X, Y) and the standby target temperatures ($X_o$, $Y_o$) of the individual roll by the aforementioned fixed temperature comparing means reveals that both the actually measured temperature values of the individual rolls are lower than the standby target temperatures (i.e., $X<X_o$ and $Y<Y_o$). Which of the first heating means and the second heating means is to be driven is arbitrary, but it is preferable in view of the energy efficiency to heat the roll which is in contact with the front side of the recording sheet.

Figure 8:
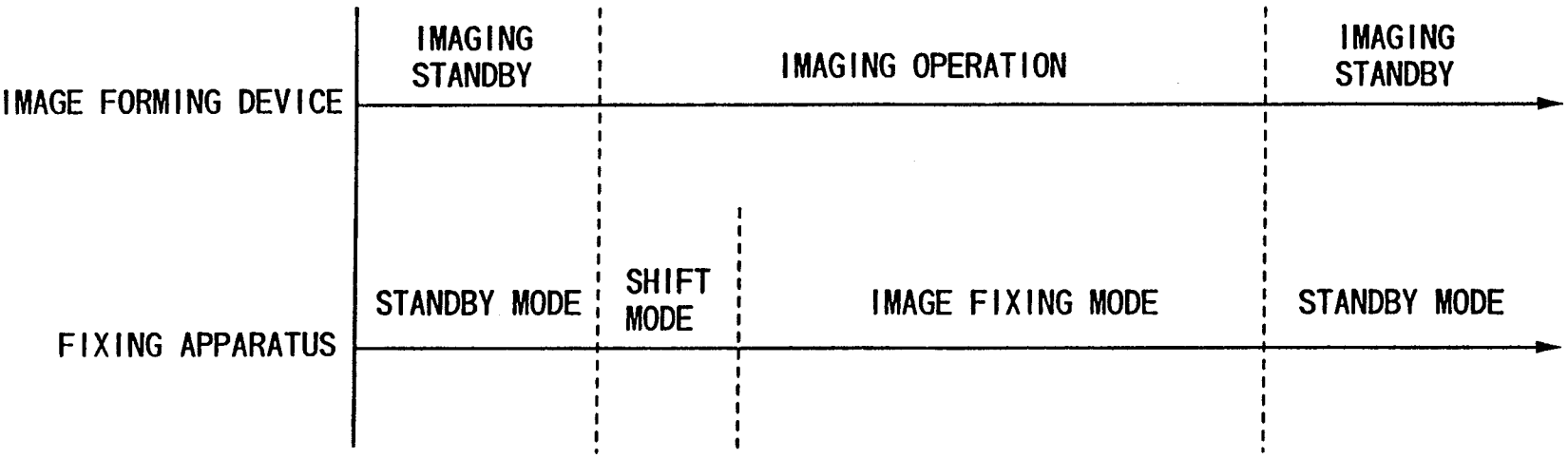
FIG. 8 is a timing chart showing the relations between the aforementioned third temperature control method and the operating state of the image forming device.

FIG. 8 is a timing chart showing the correspondence between the imaging operation of the image forming device and the individual modes. The start of the shift mode is synchronized with the imaging start of the image forming device, but the switching from the shift mode to the image fixing mode may occur at an arbitrarily predetermined timing. If, however, the actually measured temperature values (X, Y) of the individual rolls are present in the zone P, as shown in FIG. 7, at the switching time from the shift mode to the image fixing mode, there arises a problem similar to that of the foregoing second temperature control method. It is, therefore, preferable that the mode is switched from the shift mode to the image fixing mode at the instant when the actually measured temperature values (X, Y) of the individual rolls move to the zone Q. This instant is specifically exemplified by that when the result of comparison between the target surface temperature y of the second roll and the actually measured temperature value Y of the second roll takes the relation of $Y<y$ for the first time after the imaging operation of the image forming device is started.

On the other hand, the shift mode may be switched to the image fixing mode at the instant when the number of recording sheets having been continuously formed with images reaches a predetermined number n. This sheet number n is determined by assuming that the actually measured temperature values (X, Y) of the individual rolls are present in the zone P when an image is formed in at least an n-th recording sheet, and that the actually measured temperature values (X, Y) of the individual rolls move to the zone Q when an image is formed in an (n+1)-th recording sheet. Since the total amount of thermal energy required for fixing the toner image is different for the imaging operations of the image forming device, as has already been described, the aforementioned sheet number n may preferably be selected for use from such an optimum one of a plurality of prepared values $n_1$, $n_2$, $n_3$, . . . , and so on as can match the imaging operation at that time.

Moreover, the switching from the shift mode to the image fixing mode may be timed when a predetermined time period t elapses after the imaging operation by the image forming device has been started. In this case, moreover, the time period t may preferably be selected for use from such an optimum one of a plurality of prepared values $t_1$, $t_2$, $t_3$, . . . , and so on as can match the imaging operation of the image forming device.

In case, on the other hand, the timing for switching the shift mode to the image fixing mode is determined in accordance with the number of recording sheets and the lapse time, as described above, the coefficient B of the fixing characteristic formula: $y=Ax+B$ may preferably be determined by making use of the actually measured temperature values ($X_N$, $Y_N$) of the individual rolls at the instant when the image fixing mode is started. In other words, the coefficient B can be determined from $B=Y_N-AX_N$. If the coefficient B is thus determined, the actually measured temperature values (X, Y) of the individual rolls at the initial stage of the start of the image fixing mode never fail to exist in the zone Q, as shown in FIG. 7, to avoid a trouble that neither heating means is driven at the instant of switching the shift mode to the image fixing mode.

Incidentally, in the image fixing mode of the present invention, the target surface temperature y required for the second roll to reproduce the arbitrarily predetermined fixing property is computed from the actually measured temperature value X of the first roll. As a result, the lowest surface temperature $y_L$ required for the second roll to retain the minimum fixing property allowable for a recorded image can also be computed from the actually measured temperature value X of the first roll. If, moreover, the computed lowest surface temperature $y_L$ of the second roll and the actually measured temperature value Y of the second roll are compared, it is possible to accurately decide whether or not the fixing apparatus can fix the toner image on the recording sheet.

Therefore, a fourth temperature control method according to the present invention comprises a diagnosis mode to be executed in the imaging operation of the image forming device. The diagnosis mode comprises: a computing step of computing the lowest surface temperature $y_L$ required of the second roll from an actually measured temperature value X of the first roll; a lowest temperature comparing step of comparing the lowest surface temperature $y_L$ and an actually measured temperature value Y of the second roll; and a self-diagnosis step of diagnosing the capability of fixing on the basis of the result of comparison.

Moreover, a fixing apparatus for practicing this method comprises: a first roll 1 having first heating means 1*a* therein; a second roll 2 having second heating means 2*a* therein; first temperature detecting means 5 for detecting the surface temperature of the first roll 1; second temperature detecting means 6 for detecting the surface temperature of the second roll 2; control means 17 for controlling the first heating means 1*a* and the second heating means 2*a*; and diagnosis mode executing means for diagnosing the capability of executing the fixing operation. The diagnosis mode executing means includes: computation means 18 for computing the lowest surface temperature $y_L$ required of the second roll 2 to reproduce a predetermined fixing property from the temperature value X of the first roll 1, which is actually detected by the first temperature detecting means 5; lowest temperature comparing means 19 for comparing the lowest surface temperature $y_L$ and the temperature value Y of the second roll 2, which is actually detected by the second temperature detecting means 6; and self-diagnosis means 20 for deciding the capability of the fixing operation on the basis of the result of comparison.

A function to be used for computing the lowest surface temperature $y_L$ of the second roll is exemplified by a fixing decision formula of $y_L = AX + C$ which is modified by changing the coefficient B of the fixing characteristic formula: $y = Ax + B$, as has been used in the aforementioned image fixing mode. The aforementioned coefficient C is one indicating the minimum fixing property of the toner image and has a relation of $B \geqq C$ with respect to the aforementioned coefficient B indicating an arbitrary fixing property. Since this coefficient C is different depending upon the total amount of thermal energy required for fixing the toner image, a plurality of values may preferably be prepared depending upon the thickness and material of the recording sheets or the difference in the color number of the toner image.

The temperature control method and a fixing apparatus for practicing the method will be described in detail in the following with reference to the accompanying drawings.

(1) Apparatus Structure

Figure 9:
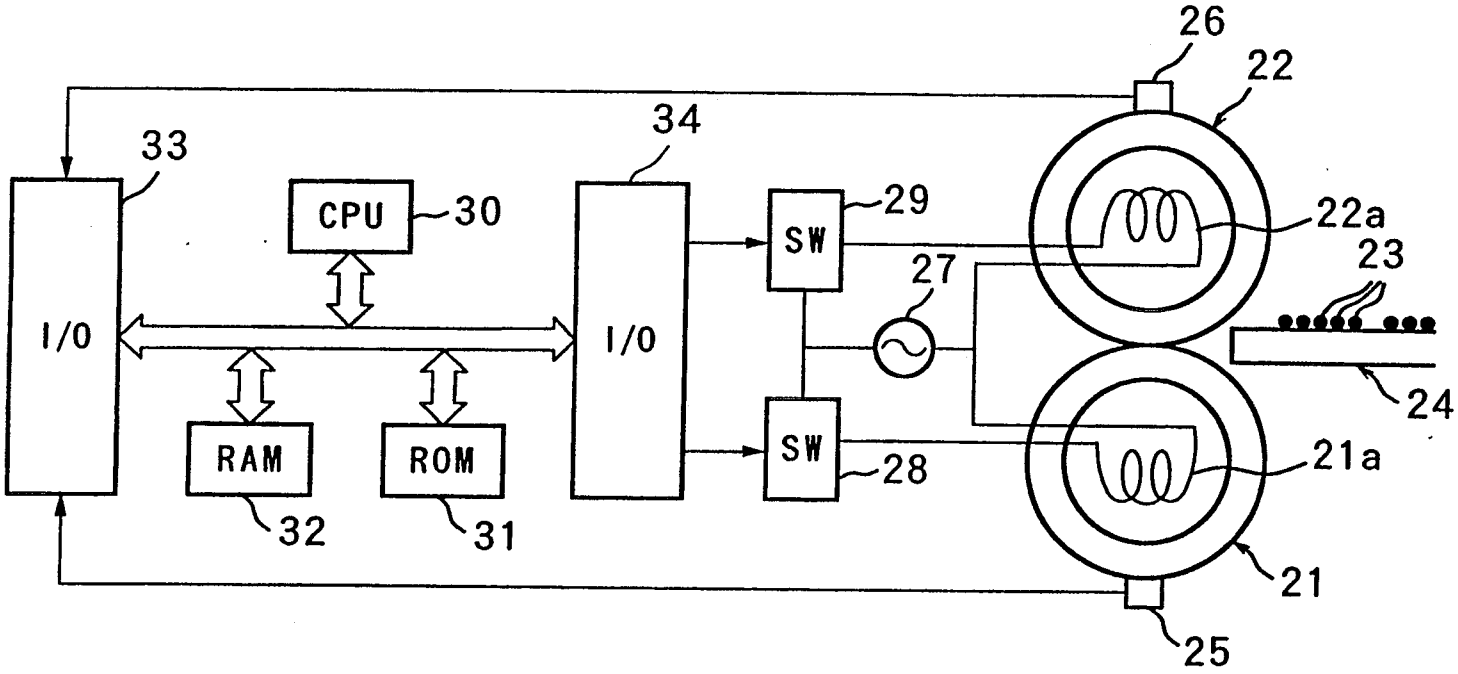
FIG. 9 is a diagram showing a specific structure of a fixing apparatus described in the embodiment.

FIG. 9 shows an example of the basic structure of the fixing apparatus according to the present invention.

In FIG. 9, reference numeral 21 designates a first roll having a heater 21*a* therein, and numeral 22 designates a second roll having a heater 22*a* therein. These first roll 21 and second roll 22 are forced into contact with each other. Numeral 24 designates a recording sheet carrying a toner image 23. This recording sheet has the toner image 23 transferred onto its front by a not-shown image forming device and is then fed into a clearance between those first roll 21 and second roll 22. The first roll 21 is equipped on its surface with a first temperature sensor 25 for detecting the surface temperature X of the first roll 21 on the basis of the signal detected by the first temperature sensor 25. The second roll 22 is equipped on its surface with a second temperature sensor 26 for detecting the surface temperature Y of the second roll 22 on the basis of the signal detected by the second temperature sensor 26. The aforementioned heaters 21*a* and 22*a* have their one-terminals connected in parallel with a power supply 27, and the other end of the heater 21*a* is connected with a switching element 28 whereas the other end of the heater 22*a* is connected with a switching element 29. These switching elements 28 and 29 are connected with a later-described drive control system, which outputs a heater control signal for energizing the heater 21*a* and the heater 22*a*.

This drive control system will be described in the following. Numeral 30 designates a CPU for controlling a variety of computations and a variety of systematic controls; numeral 31 designates a ROM stored with a variety of data and programs; and numeral 32 designates a RAM for storing a variety of results of computations of the CPU. CPU 30, ROM 31 and RAM 32 are connected through buses. The detection signals of the aforementioned first temperature sensor and second temperature sensors are fetched through an input interface circuit 33 by the CPU 30, and heater control signals based on the various computations of the CPU 30 are outputted through an output interface circuit 34 to the aforementioned switching elements 28 and 29.

The essential components of the present invention—the standby mode executing means, the image fixing mode executing means, the shift mode executing means and the diagnosis mode executing means—are realized as the functions of the aforementioned drive control system. The image fixing mode executing means will be described by way of example. The fixing characteristic formula for computing the target temperature of the second roll is stored in the aforementioned ROM 31, and the computed temperature comparing means, the reference temperature comparing means and the fixing time drive means are realized as the functions of the aforementioned CPU 30.

Figure 10:
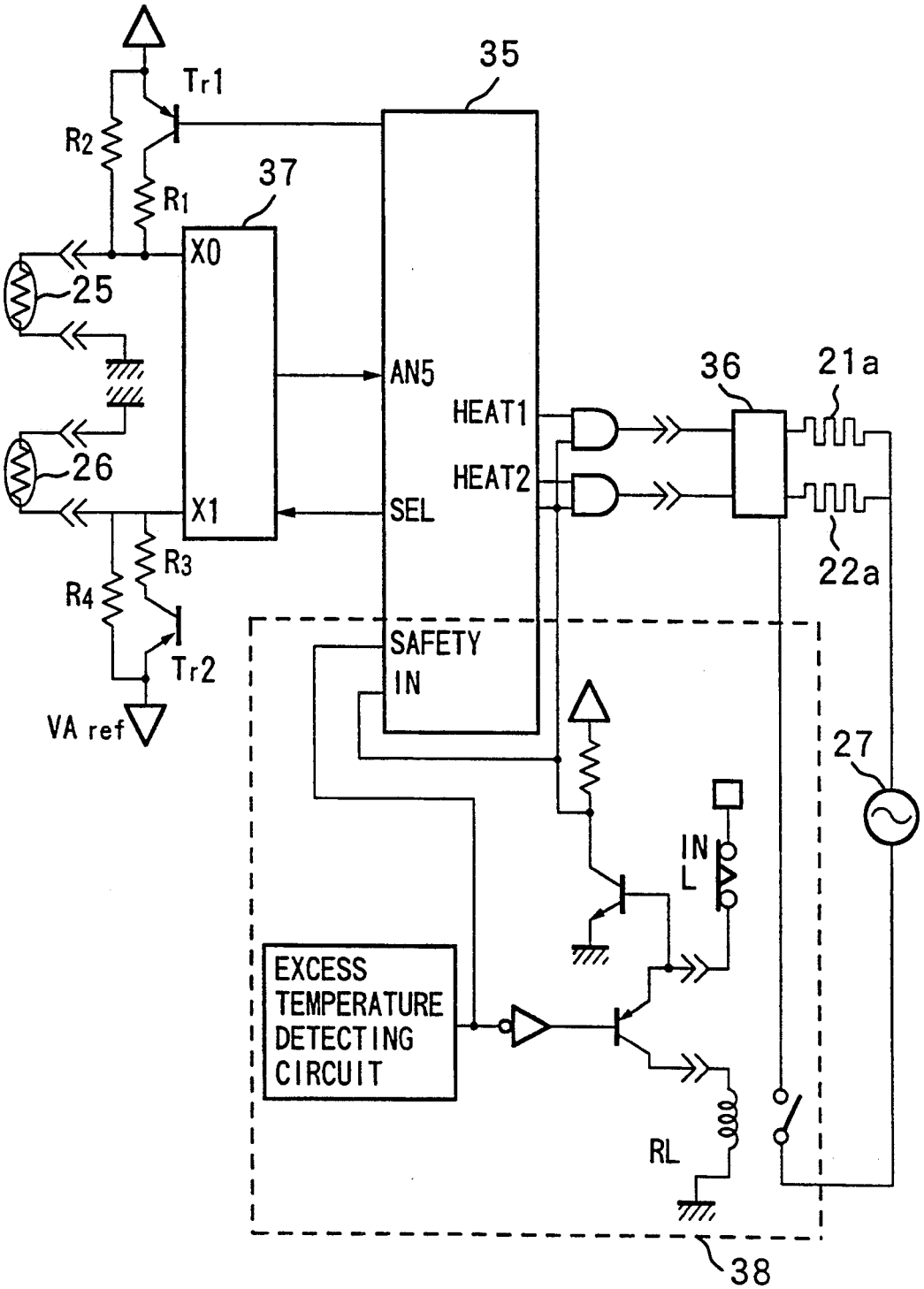
FIG. 10 is a circuit diagram showing a fixing apparatus described in the embodiment.

FIG. 10 is a basic circuit diagram showing the fixing apparatus of the present invention.

Reference numeral 35 designates a drive control circuit in which the aforementioned CPU 30, ROM 31, RAM 32, input interface circuit 33 and output interface circuit 34 are integrated. Numeral 36 designates a relay circuit having the aforementioned switching elements 38 and 29 packaged therein, and numeral 37 designates a multiplexer, to which the detection signals of the aforementioned first temperature sensor and second temperature sensor are inputted. In accordance with a binary signal outputted from the aforementioned drive control circuit 35, the multiplexer 37 inputs one of the detection signals of the two temperature sensors 25 and 26 to the aforementioned drive control circuit 35. Incidentally, numeral 38 designates a safety circuit for preventing the overheat of the heater 21*a* or 22*a*.

(2) Control Method

Next, the specific temperature control method of the fixing apparatus thus constructed will be described in the following. The temperature control method of the present embodiment is composed, as shown in FIG. 8, of: a standby mode to be executed during the imaging standby of the image forming device; a shift mode to be executed, if necessary, at the initial stage of the start of the imaging operation; and an image fixing mode to be executed during the imaging operation subsequent to the aforementioned shift mode. During the execution of the image fixing mode, moreover, there is simultaneously executed a diagnosis mode for deciding whether or not the minimum fixing property allowable as the recorded image can be retained.

The specific controls of the heaters 21*a* and 22*a* in the individual modes will be described at first, followed by the starts and ends of the individual modes.

(2.1) Heater Controls in Individual Modes

① Standby Mode

In the standby mode, the predetermined standby surface temperatures and the temperature values of the rolls actually measured by the temperature sensors are compared to energize the heaters packaged in the rolls on the basis of the results of comparison. As to the first roll 21, specifically, the standby surface temperature $X_o$ is set so that the switching element 28 is shorted by the heater control signal outputted from the drive control system to energize the heater 21*a*, if the actually measured temperature value X of the first roll 21 detected by the first temperature sensor 25 satisfies the relation of $X<X_o$. As to the second roll 22, specifically, the standby surface temperature $Y_o$ is set so that the switching element 29 is shorted by the heater control signal outputted from the drive control system to energize the heater 22*a*, if the actually measured temperature value Y of the second roll 22 detected by the second temperature sensor 26 satisfies the relation of $Y<Y_o$. Thus, whether or not a heater is to be energized is determined exclusively by the surface temperature of the roll having that heater packaged therein but not by the surface temperature of the other roll in the least. The combinations of the results of comparison of the first roll 21 and the results of comparison of the second roll 22, and the drive situations of the heaters 21*a* and 22*a* at that time are enumerated in Table 1. The standby surface temperature $X_o$ of the first roll is 155° C., for example, and the standby surface temperature $Y_o$ of the second roll is 155° C., for example. These values are more or less different depending upon the materials and structures of the individual rolls and the materials of the toners to be fixed.

TABLE 1

| Results of comparison | Drive situations of the heaters: Heater 21a | Heater 22a |
|---|---|---|
| $X \geqq X_0, Y \geqq Y_0$ | Deenergize | Deenergize |
| $X \geqq X_0, Y < Y_0$ | Deenergize | Energize |
| $X < X_0, Y < Y_0$ | Energize | Energize |
| $X < X_0, Y \geqq Y_0$ | Energize | Deenergize |

② Shift Mode

The shift mode is identical to the aforementioned standby mode in that the actually measured temperature value X of the first roll 21 is compared with the aforementioned standby surface temperature $X_o$ and in that the actually measured temperature value Y of the second roll 22 is compared with the aforementioned standby surface temperature $Y_o$. Since, however, this shift mode is started in synchronism with the start of the imaging operation of the image forming device, the electric power for energizing the heaters 21*a* and 22*a* simultaneously cannot be retained. Thus, which of the heaters 21*a* and 22*a* is to be energized is decided from the combination of the result of comparison of the temperatures of the first roll 21 and the result of comparison of the temperatures of the second roll 22. Specifically, if the actually measured temperature value Y of the second roll 22 contacting with the front side of the recording sheet 4 is lower than the standby surface temperature $Y_o$ (i.e., $Y<Y_o$), the second heater 22 is always energized irrespective of the result of comparison of the first roll 21. The combinations of the result of comparison of the first roll 21 and the result of comparison of the second roll 22, and the drive situations of the heaters 21*a* and 22*a* at that time are enumerated in Table 2.

TABLE 2

| Results of comparison | Drive situations of the heaters: Heater 21a | Heater 22a |
|---|---|---|
| $X \geqq X_0, Y \geqq Y_0$ | Deenergize | Deenergize |
| $X \geqq X_0, Y < Y_0$ | Deenergize | Energize |
| $X < X_0, Y < Y_0$ | Deenergize | Energize |
| $X < X_0, Y \geqq Y_0$ | Energize | Deenergize |

③ Image Fixing Mode

Basic Example

In this image fixing mode, the heater 22*a* is energized only if the target surface temperature y required for the second roll 22 to reproduce the predetermined fixing property is computed from the actually measured temperature value X of the first roll 21 so that the actually measured temperature value Y of the second roll 22 is below the aforementioned target surface temperature y (i.e., $Y<y$). The target surface temperature y of the second roll 22 is computed by the fixing characteristic formula of $y=Ax+B$ having the surface temperature x of the first roll 21 as its variable, and this formula is stored in advance in the aforementioned ROM 31.

Figure 11:
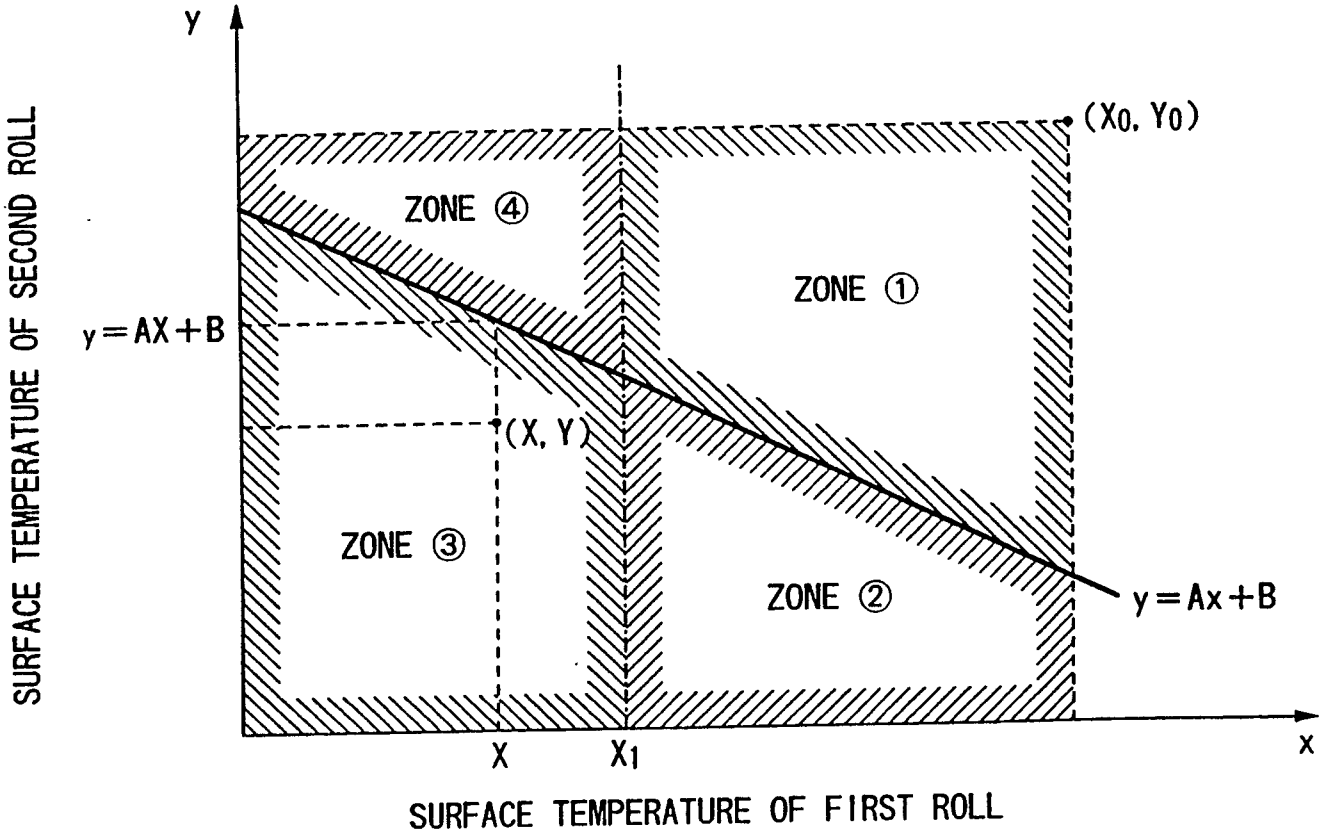
FIG. 11 is a graph illustrating the temperature control method of a fixing apparatus described in the embodiment.

The aforementioned coefficient A is $-0.3$, for example, and the aforementioned coefficient B is 180° C., for example. Hence, the fixing characteristic formula is rewritten into $y=-0.3x+180$ so that the target surface temperature y of the second roll 22 is computed to 141° C. from the fixing characteristic formula if the actually measured temperature value of the first roll 21 is exemplified by 130° C. However, these coefficients A and B are more or less different depending upon the materials and structures of the infividual rolls, the materials of the toners to be fixed, or the feeding rates of the recording sheets. FIG. 11 presents a graph of the fixing characteristic formula.

It is also considerable that the actually measured temperature value X of the first roll 21 may be extremely low even if the actually measured temperature value Y of the second roll exceeds the aforementioned target surface temperature y. Thus, the actually measured temperature value X of the first roll 21 is compared with the preset reference temperature value $X_1$. If, moreover, the actually measured temperature value X of the first roll 21 is below the reference temperature value $X_1$ (i.e., $X<X_1$), the energization of the heater 22*a* is interrupted at the instant when the actually measured temperature value Y of the second roll exceeds the aforementioned target surface temperature y, and the heater 21*a* is then energized. The aforementioned reference temperature value $X_1$ is 145° C., for example, and this value is more or less different depending upon the materials of the toners to be fixed.

Table 3 enumerates the combinations of the result of comparison of the aforementioned target surface temperature y and the result of comparison of the aforementioned reference temperature value $X_1$, and the drive situations of the heaters 21*a* and 22*a* at that time. These four combinations imply what of the zones ① to ④ shown in FIG. 11 the combined coordinates (X, Y) of the actually measured temperature value X of the first roll 21 and the actually measured temperature value Y of the second roll 22 belong to. If the coordinates (X, Y) belong to the zone ③, for example, the heater 22*a* is energized at first to raise the surface temperature Y of the second roll 22. As a result, the coordinates (X, Y) move to the zone ④ so that the heater 21 is then energized to bring the coordinates (X, Y) to the zone ① at last. If the coordinates (X, Y) belong to the zone ②, on the other hand, the heater 22*a* is energized to move the coordinates (X, Y) to the zone ①. Specifically, in this image fixing mode, either of the heaters is energized till the combinations (X, Y) of the actually measured temperature value X of the first roll 21 and the actually measured temperature value Y of the second roll 22 come to belong to the zone ①.

TABLE 3

| Results of comparison | Drive situations of the heaters | |
|---|---|---|
| | Heater 21a | Heater 22a |
| $X \geqq X_1, Y \geqq y$ (zone ①) | Deenergize | Deenergize |
| $X \geqq X_1, Y < y$ (zone ②) | Deenergize | Energize |
| $X < X_1, Y < y$ (zone ③) | Deenergize | Energize |
| $X < X_1, Y \geqq y$ (zone ④) | Energize | Deenergize |

Modification

If the actually measured temperature value Y of the second roll 22*a* is below the aforementioned target surface temperature y (i.e., $Y<y$), the heater 21*a* is energized. If, even in this case (i.e., $Y<y$), the actually measured temperature value X of the first roll is over the reference temperature value $X_1$ (i.e., $X \geqq X_1$), the heater 22*a* is energized with a view to preventing the overheat of the first roll. Table 4 enumerates the combinations of the result of comparison of the aforementioned target surface temperature y and the result of comparison of the aforementioned reference temperature value $X_1$, and the drive situations of the heaters 21*a* and 22*a* at that time.

TABLE 4

| Results of comparison | Drive situations of the heaters | |
|---|---|---|
| | Heater 21a | Heater 22a |
| $X \geqq X_1, Y \geqq y$ (zone ①) | Deenergize | Deenergize |
| $X \geqq X_1, Y < y$ (zone ②) | Deenergize | Energize |
| $X < X_1, Y < y$ (zone ③) | Energize | Deenergize |
| $X < X_1, Y \geqq y$ (zone ④) | Energize | Deenergize |

④ Diagnosis Mode

In the diagnosis mode, the lowest surface temperature $y_L$ required for the second roll 22 to fix the toner image onto the recording sheet is computed from the actually measured temperature value X of the first roll 21. If the actually measured temperature value Y of the second roll 22 is below the aforementioned lowest surface temperature $y_L$ (i.e., $Y<y_L$), it is decided that the fixing of the toner image is imposible at the surface temperatures of the individual rolls at that instant. The lowest surface temperature $y_L$ of the second roll 22 is computed from the fixing decision formula of $y_L=Ax+C$, which is obtained by modifying the coefficient B of the fixing characteristic formula in the aforementioned image fixing mode, and this fixing decision formula is stored in advance in the aforementioned ROM 31.

The aforementioned coefficient C is 165° C., for example, and the coefficient A used has the same value as that in the aforementioned image fixing mode, as exemplified by $A=-0.3$. As a result, the fixing decision formula is rewritten into $y_L=-0.3x+165$ so that the lowest surface temperature $y_L$ of the second roll 22 is computed to 126° C. from the fixing decision formula if the actually measured temperature value X of the first roll 21 is exemplified by 130° C. Here, the coefficient C of the fixing decision formula exhibits the minimum fixing property so that it is apparently smaller than the coefficient B of the fixing characteristic formula.

(2.2) Starts and Ends of Individual Modes

The starts and ends of the individual modes will be described in the following while following the flows from the power ON to the copying operation of the copying machine.

① Start and End of Standby Mode

Figure 12:
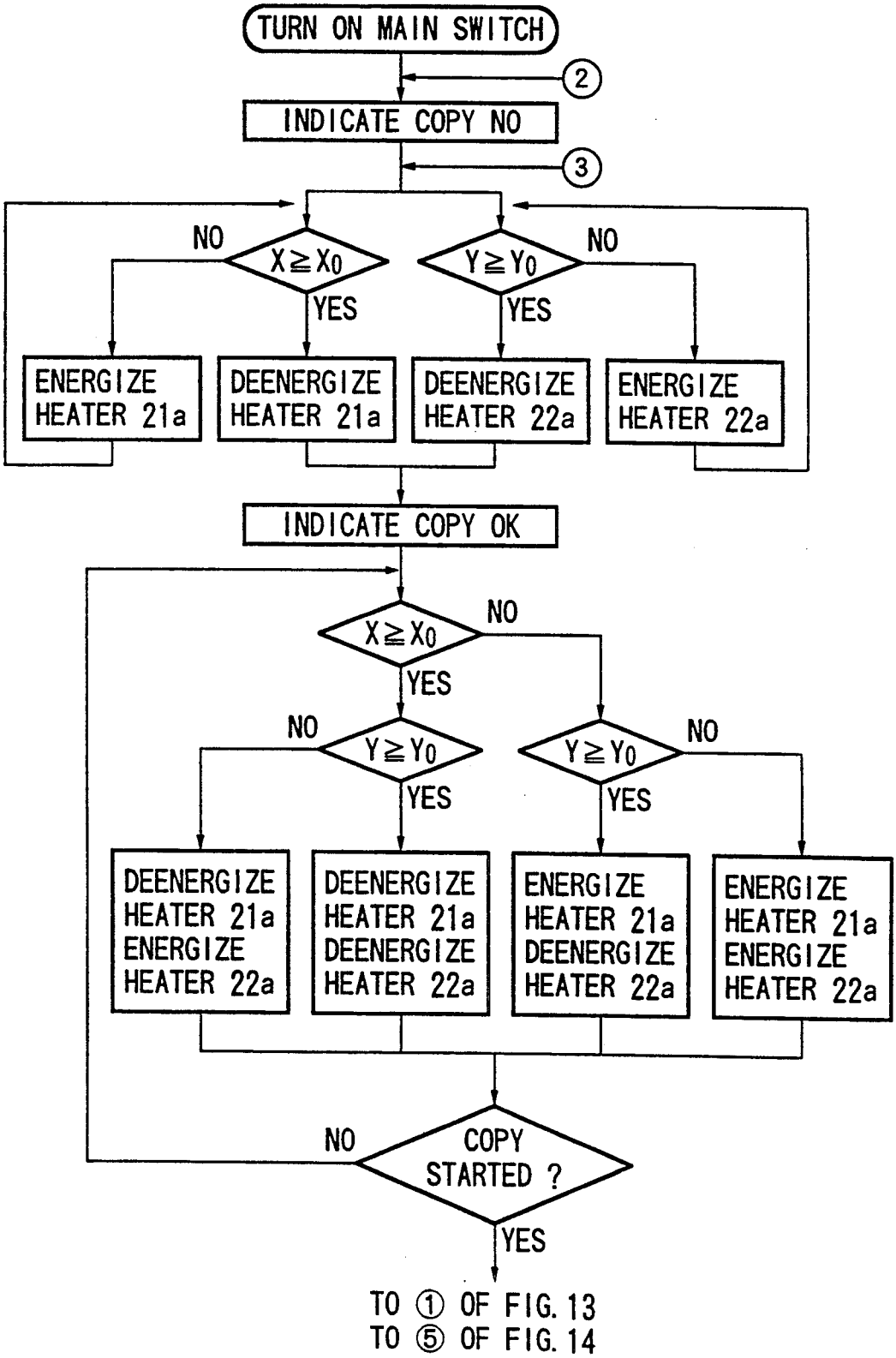
FIG. 12 is a flow chart showing a standby mode of the temperature control method described in the embodiment.

FIG. 12 is a flow chart showing the standby mode. When the main switch of the copying machine is turned on, the standby mode is started by the CPU 30 having received the ON signal. Since, at this stage, both the actually measured temperature value X of the first roll and the actually measured temperature value Y of the second roll 22 do not reach the standby surface temperature, both the heaters 21*a* and 22*a* are energized. On the other hand, the display of the copying machine indicates "Copy NO". When the actually measured temperature value X of the first roll 21 exceeds the standby surface temperature $X_o$ as the time elapses, the heater 21*a* is deenergized. When the actually measured temperature value Y of the second roll 22 exceeds the standby surface temperature $Y_o$, the heater 22*a* is deenergized. At the instant when both the heaters 21*a* and 22*a* are deenergized for the first time, the display of the copying machine indicates "Copy OK".

Even after the "Copy OK" has been indicated, the aforementioned standby mode is executed so that the CPU 30 compares the actually measured temperature values X and Y of the individual rolls 21 and 22 with the standby surface temperatures $X_o$ and $Y_o$, respectively, to energize and deenergize the heaters 21*a* and 22*a* in accordance with the four combinations enumerated in Table 1. These procedures are executed at a predetermined time interval so that the surface temperature of the first roll 21 is held in the vicinity of the standby surface temperature $X_o$ whereas the surface temperature of the second roll 22 is held in the vicinity of the standby surface temperature $Y_o$. Then, the standby mode is ended when the copy start signal is inputted to the CPU 30.

(2) Start and End of Shift Mode

Embodiment 1

Figure 13:
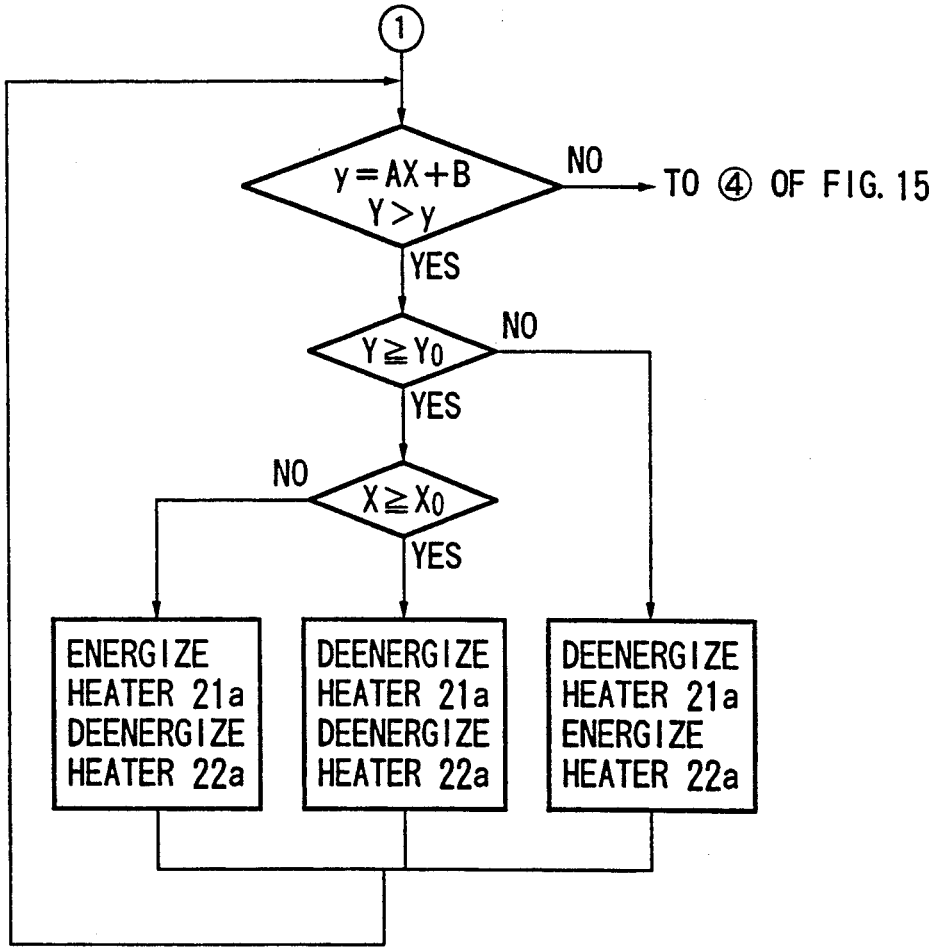
FIG. 13 is a flow chart showing a shift mode of a temperature control method described in the embodiment.

FIG. 13 is a flow chart showing a first embodiment of the start and end of the shift mode. When the CPU 30 ends the standby mode in response to the copy start signal, it decides which of the shift mode and the image fixing mode is to be executed. This decision is executed by comparing the target surface temperature of $y=AX+B$ of the second roll 22, which is computed from the actually measured temperature value X of the first roll 21 at the end of the standby mode and the aforementioned fixing characteristic formula, with the actually measured temperature value Y of the second roll 22. Only if the actually measured temperature value Y of the second roll 22 is over the computed target surface temperature y (i.e., $Y>y$), the shift mode is started. In other words, this shift mode is started only if the temperature coordinates (X, Y) of the individual rolls 21 and 22 at the end of the standby mode are present in the zone (1) or (4) shown in FIG. 11. The coefficiant B of the fixing characteristic formula is stored in advance in the ROM 31 as the plurality of coefficients $B_1$, $B_2$, $B_3$, - - - , and so on so that the CPU 30 reads out the optimum coefficient B from the ROM 31 in response to the recording sheet selecting signal or the color copy selecting signal coming from the control board of the copying machine and uses that coefficient for the computations. In the subsequent image fixing mode, too, the coefficient B thus read is used for the computations.

While the shift mode is being executed, the CPU compares the actually measured temperature value Y of the second roll 22 at first with the standby surface temperature $Y_o$ to energize the heater 22*a* if $Y<Y_o$. If $Y\geqq Y_o$, on the other hand, the CPU 30 further compares the actually measured temperature value X of the first roll 21 with the standby surface temperature $X_o$ to energize the heater 21*a* on the basis of the result of comparison. These procedures are executed at a predetermined time interval, the actually measured temperature value Y of the second roll 22 is not compared with the standby surface temperature $Y_o$ before the actually measured temperature value Y of the second roll 22 and the target surface temperature y are compared.

And, the shift mode is ended at the instant when the actually measured temperature value Y of the second roll 22 is below the target surface temperature y (i.e., $Y\geqq y$).

Embodiment 2

Figure 14:
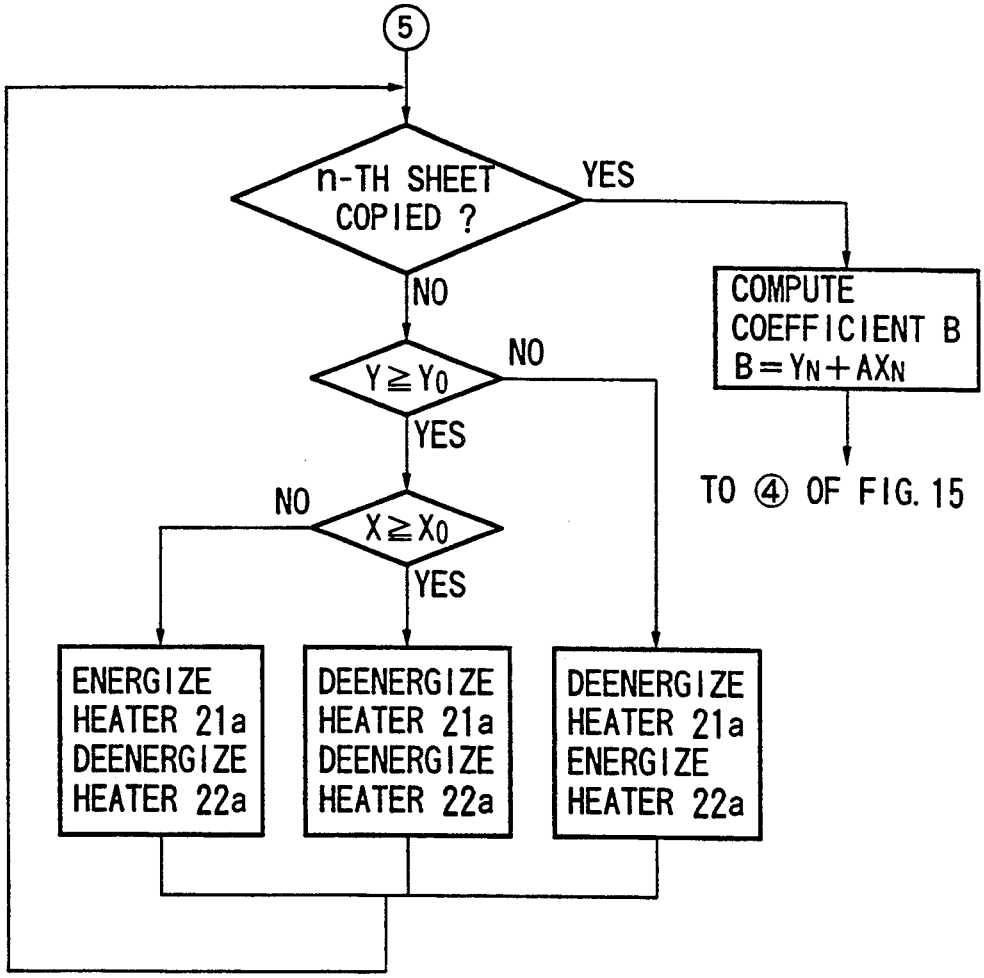
FIG. 14 is a flow chart showing another embodiment of the shift mode.

FIG. 14 is a flow chart showing a second embodiment of the start and end of the shift mode. In this embodiment, the shift mode never fails to be started when the CPU 30 receives the copy start signal to end the standby mode.

The ending instant of the shift mode in this embodiment occurs when the number of recording sheets copied reaches an n-th sheet. As a result, the actually measured temperature values X and Y of the individual rolls 21 and 22 exert no influences upon the decision of the end of the shift mode. In this embodiment, moreover, the coefficient B of the aforementioned fixing characteristic formula is determined from the computation of $B=Y_N-AX_N$ by making use of the actually measured temperature $X_N$ of the first roll 21 and the actually measured temperature $Y_N$ at the end of the shift mode.

The number n of the recording sheet for providing a reference for deciding the shift mode is stored in advance in the ROM 31 as a plurality of numbers $n_1$, $n_2$, $n_3$, - - - , and so on so that the CPU 30 reads out the optimum sheet number n from the ROM 31 in response to the recording sheet selecting signal or the color copy selecting signal coming from the control board of the copying machine and uses that number as a reference for deciding the end of the shift mode. In this embodiment, therefore, the coefficient B of the fixing characteristic formula is different depending upon the recording sheet selecting signal or the color copy selecting signal inputted to the CPU 30.

The number n of the aforementioned recording sheets to be used is exemplified by $n=15$, in case recording sheets of A3 size are to be copied, and by $n=30$ in case recording sheets of A4 size are to be copied. As a matter of fact, the sheet number n is more or less different depending on the materials and structures of the individual rolls, the materials of the toners to be fixed, or the feeding rate of the recording sheets.

(3) Start and End of Image Fixing Mode

Figure 15:
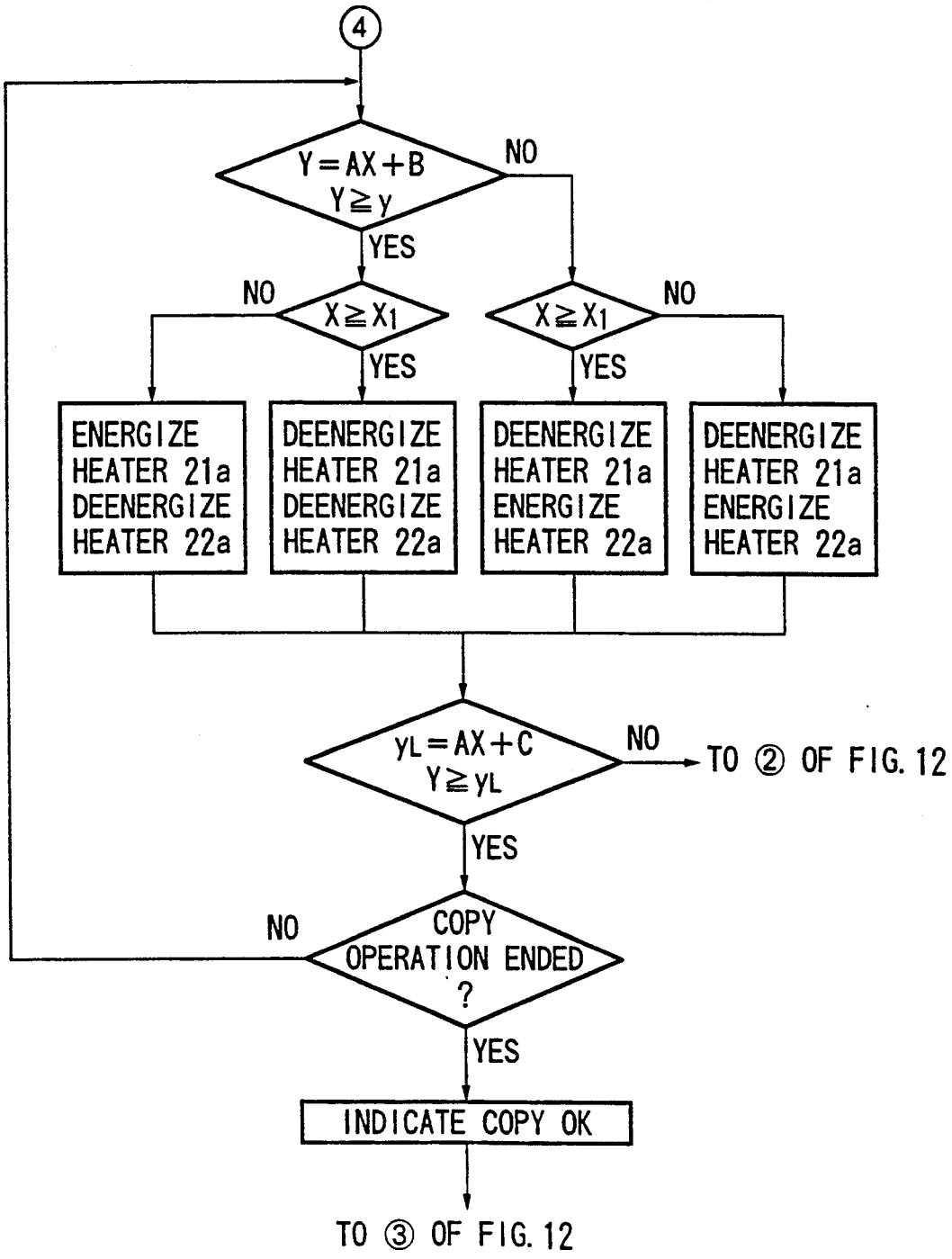
FIG. 15 is a flow chart showing an image fixing mode and a diagnosis mode of a temperature control method described in the embodiment.

FIG. 15 is a flow chart showing the procedures from the start to the end of the image fixing mode. When the shift mode is ended, the CPU 30 executes the image fixing mode. In this image fixing mode, the CPU 30 computes at first the target surface temperature y of the second roll 22 from the actually measured temperature value X of the first roll 21 and then compares this target surface temperature y with the actually measured temperature value Y of the second roll 22. Moreover, the CPU 30 compares the actually measured temperature value X of the first roll 21 and the reference temperature value $X_1$. In accordance with the combination enumerated in Table 3, the CPU 30 energizes either the heater 21*a* or 22*a*. The procedures thus far described are repeated at a predetermined time interval. The image fixing mode is ended simultaneously with the end of the copying operation, and the standby mode is executed after the end of the image fixing mode.

The start of the image fixing mode is not always timed with the end of the shift mode. If it is decided in the first embodiment of the shift mode that the execution of the shift mode is unnecessary, the image fixing mode is started at the end of the standby mode. If, for example, a copy operation is started a short time after a copying operation is once ended to shift the mode from the image fixing mode to the standby mode, the temperature coordinates (X, Y) composed of the actually measured temperature values of the individual rolls 21 and 22 may possibly be present In the zone (2) or (3) shown in FIG. 11. In this case, therefore, the image fixing mode is started without no execution of the shift mode.

(4) Start and End of Diagnosis Mode

The diagnosis mode is executed simultaneously with the image fixing mode. As shown in FIG. 15, the CPU 30 controls the energizations of the individual heaters 21*a* and 22*a* and then computes the lowest fixing temperature $y_L$ of the second roll 22 from the fixing decision formula stored in the ROM 31 and the actually measured temperature value X of the first roll 21. The CPU 30 compares the computed lowest fixing temperature $y_L$ with the actually measured temperature value Y of the second roll 22. If, moreover, the actually measured temperature value Y of the second roll 22 is over the lowest fixing temperature $y_L$ (i.e., $Y \geqq y_L$), the image fixing mode is continuously executed under the decision that the minimum fixing property of the toner image is retained. If, on the contrary, the actually measured temperature value Y of the second roll 22 is below the lowest fixing temperature $y_L$ (i.e., $Y < y_L$), the image fixing mode is forcibly ended to start the standby mode under the decision that the toner image cannot be fixed on the recording sheet. At this time, the CPU 30 outputs the "Copy NO" signal so that the display of the copying machine indicates "Copy NO".

(3) Summary

In the temperature control methods thus far described according to the embodiments, the energizations of the heaters 21*a* and 22*a* packaged in the individual rolls 21 and 22 are controlled during the copying operation by using the fixing characteristic formula which has been experimentally determined in advance. A constant fixing property can always be retained without applying wasteful thermal energy to the individual rolls. Even during the copying operation in which the surface temperatures of the individual rolls are liable to drop, moreover, whether or not the heaters are to be energized is synthetically decided from the actually measured surface temperatures of the two rolls. As a result, no power may be fed to the heaters even during the copying operation so that the overshoot phenomenon after the end of the copying operation can be effectively prevented.

During the copying operation, moreover, whether or not the toner image can be fixed on the recording sheet is decided by using the fixing decision formula which has been experimentally determined in advance, thereby to decide the fixing capability accurately.

What is claimed is:

1. A temperature control method for a fixing apparatus including a first roll having first heating means, and a second roll arranged to abut against said first roll and having second heating means, for thermally fixing a toner image onto a recording sheet fed from an image forming device, the method comprising an image fixing mode executed in an imaging operation of said image forming device, said image fixing mode comprising the steps of:

computing a target surface temperature y required for said second roll to reproduce a predetermined fixing property from a measured temperature X of said first roll;

a computed temperature comparing step of comparing said target surface temperature y and a measured temperature Y of said second roll; and a fixing time control step of driving said first heating means or said second heating means on the basis of the result of comparison.

2. A temperature control method for a fixing apparatus according to claim 1, wherein the computing step includes the substep of computing in accordance with the characteristic formula:

$$y = AX + B.$$

wherein:

A is a coefficient indicating the ratio of efficiencies for said first roll and said second roll to contribute to the fixing of said toner image;

X is a measured temperature of said first roll; and

B is a coefficient indicating the fixing property of said toner image.

3. A temperature control method for a fixing apparatus according to claim 2, wherein the computing step further includes the substep of computing in accordance with the coefficient B having different values in accordance with the imaging operation of said image forming device.

4. A temperature control method for a fixing apparatus according to any of claims 1 to 3, further comprising a reference temperature comparing step of comparing a determined reference temperature $X_1$ of said first roll and the measured temperature X of said first roll, and wherein said fixing time control step drives said first heating means or said second heating means on the basis of a result of said computed temperature comparing step and a result of said reference temperature comparing step.

5. A fixing apparatus for thermally fixing a toner image onto a recording sheet fed from an image forming device, comprising:

a first roll having first heating means;

a second roll having second heating means;

first temperature detecting means for detecting a surface temperature X of said first roll;

second temperature detecting means for detecting a surface temperature Y of said second roll; and means for controlling said first heating means and said second heating means, the controlling means including image fixing mode executing means for functioning during an imaging operating of said image forming device, wherein said image fixing mode executing means includes:

means for computing a target surface temperature y required for said second roll to reproduce a predetermined fixing property from the temperture X of said first roll;

computed temperature comparing means for comparing said target surface temperature y and the temperature Y of said second roll; and fixing time drive means for driving said first heating means or said second heating means on the basis of the result of comparison.

6. A fixing apparatus according to claim 5, wherein the computing means includes means for computing in accordance with the characteristic formula:

$$y = AX + B.$$

wherein:

A is a coefficient indicating the ratio of efficiencies for said first roll and said second roll to contribute to the fixing of said toner image;

X is a measured temperature of said first roll; and

B is a coefficient indicating the fixing property of said toner image.

7. A fixing apparatus according to claim 6, further including means for determining said coefficient B in accordance with the imaging operation of said image forming device.

8. A fixing apparatus according to any of claims 5 to 7, further including means for comparing a determined reference temperature $X_2$ of said first roll and the measured temperature X of said first roll, and wherein said fixing time drive means drives said first heating means or said second heating means on the basis of a result of said computed temperature comparing means and a result of said reference temperature comparing means.

9. A temperature control method for a fixing apparatus including a first roll having first heating means, and a second roll arranged to abut against said first roll and having second heating means, for thermally fixing a toner image onto a recording sheet fed from an image forming device, the method comprising a standby mode to be executed during an imaging standby of an image forming device; and an image fixing mode to be executed in an imaging operation of said image forming device, wherein said standby mode comprises the steps of:

a first comparing step of comparing a determined standby surface temperature $X_o$ of said first roll and a measured temperature X of said first roll;

a second comparing step of comparing a determined standby surface temperature $Y_o$ of said second roll and a measured temperature Y of said second roll;

a first roll control step of driving said first heating means on the basis of the result of comparison of said first comparing step; and a second roll control step of driving said second heating means on the basis of the result of comparison of said second comparing step, and wherein said image fixing mode comprises the steps of:

computing a target surface temperature y required for said second roll to reproduce a predetermined fixing property from a measured temperature X of said first roll;

a computed temperature comparing step of comparing said target surface temperature y and a measured temperature Y of said second roll; and driving said first heating means or said second heating means on a basis of the result of comparison of said computed temperature comparing step.

10. A fixing apparatus for thermally fixing a toner image onto a recording sheet fed from an image forming device, comprising: a first roll having first heating means;

a second roll having second heating means;

first temperature detecting means for detecting a surface temperature X of said first roll;

second temperature detecting means for detecting a surface temperature Y of said second roll; and control means for controlling said first heating means and said second heating means, the controlling means including standby mode executing means for functioning during an imaging standby of said image forming device; and image fixing mode executing means for functioning during an imaging operation of said image forming device, wherein said standby mode executing means includes:

first comparing means for comparing a determined standby surface temperature $X_o$ of said first roll and the measured temperature X of said first roll; second comparing means for comparing a determined standby surface temperature $Y_o$ of said second roll and the temperature Y of said second roll;

first roll control means for driving said first heating means on the basis of a result of said first comparing means;

second roll control means for driving said second heating means on the basis of a result of said second comparing means; and wherein said image fixing mode executing means includes: means for computing a target surface temperature y required for said second roll to reproduce a predetermined fixing property from the temperature X of said first roll; computed temperature comparing means for comparing said target surface temperature y and the temperature Y of said second roll; and fixing time drive means for driving said first heating means or said second heating means on the basis of the result of comparison, which is executed by said computed temperature comparing means.

11. A temperature control method for a fixing apparatus including a first roll having first heating means, and a second roll arranged to abut against said first roll and having second heating means, for thermally fixing a toner image onto a recording sheet fed from an image forming device, the method comprising a standby mode executed during an imaging standby of an image forming device; an image fixing mode to be executed in an imaging operation of said image forming device; and a shift mode to be executed, if necessary, at the initial start of the imaging operation of said image forming device, wherein said standby mode comprises the steps of:

a first comparing step of comparing a determined standby surface temperature $X_o$ of said first roll and a measured temperature of X of said first roll;

a second comparing step of comparing a determined standby surface temperature $Y_o$ of said second roll and a measured temperature Y of said second roll;

a first roll control step of driving said first heating means on the basis of the result of comparison of said first comparing step; and a second roll control step of driving said second heating means on the basis of the result of comparison of said second comparing step, wherein said image fixing mode comprises the steps of:

computing a target surface temperature y required for said second roll to reproduce a predetermined fixing property from a measured temperature X of said first roll;

a computed temperature comparing step of comparing said target surface temperature y and a measured temperature Y of said second roll; and driving said first heating means or said second heating means on the basis of the result of comparison of said computed temperature comparing step, and wherein said shift mode comprises the steps of:

said first comparing step;

said second comparing step; and a shifting time control step of driving said first heating means or said second heating means on the basis of the results of comparison of said first comparing step and said second comparing step.

12. A temperature control method for a fixing apparatus according to claim 11, wherein said image fixing mode is executed after a predetermined number of recording sheets have passed through said fixing apparatus from the start of the imaging operation of said image forming device, and wherein said shift mode is executed during the time period after the start of the imaging operation of said image forming device and before the execution of said image fixing mode.

13. A temperature control method for a fixing apparatus according to claim 12, wherein the numbers of recording sheets to pass through said fixing apparatus in said shift mode are different in dependence upon the imaging operation of said image forming device.

14. A temperature control method for a fixing apparatus according to claim 11, wherein said image fixing mode is executed after lapse of a predetermined time period from the start of the imaging operation of said image forming device, and wherein said shift mode is executed during the time period after the start of the imaging operation of said image forming device and before the execution of said image fixing mode.

15. A temperature control method for a fixing apparatus according to claim 14, wherein the execution time periods of said shift mode are different in dependence upon the imaging operation of said image forming device.

16. A temperature control method for a fixing apparatus according to any of claims 12 to 15, wherein the target temperature computing step includes the substep of computing in accordance with the characteristic formula:

$$y=AX+B,$$

wherein:

A is a coefficient indicating the ratio of efficiencies for said first roll and said second roll to contribute to the fixing of said toner image;

X is a measured temperature of said first roll; and

B is a coefficient indicating the fixing property of said toner image, and wherein said coefficient B is computed from the following formula after a measured temperature $X_N$ of said first roll and a measured temperature $Y_N$ of said second roll at a time of starting the execution of said image fixing mode have been detected:

$$B=Y_N-AX_N.$$

17. A temperature control method for a fixing apparatus according to claim 11, wherein said image fixing mode is not executed before the result of comparison between the target surface temperature y of said second roll and the temperature Y of said second roll satisfies $Y<y$ for the first time, and wherein said shift mode is executed during the time period after the initial start of the imaging operation of said image forming device and before the execution of said image fixing mode.

18. A temperature control method for a fixing apparatus according to claim 17, wherein the target temperature computing step includes the substep of computing in accordance with the characteristic formula:

$$y=AX+B,$$

wherein:

A is a coefficient indicating the ratio of efficiencies of said first roll and said second roll to contribute to this fixing of said toner image;

X is a measured temperature of said first roll; and

B is a coefficient indicating the fixing property of said toner image, and wherein said coefficient B takes different values in dependence upon the imaging operation of said image forming device.

19. A fixing apparatus for thermally fixing a toner image onto a recording sheet fed from an image forming device, comprising:

a first roll having first heating means;

a second roll having second heating means;

first temperature detecting means for detecting a surface temperature X of said first roll;

second temperature detecting means for detecting a surface temperature Y of said second roll; and means for controlling said first heating means and said second heating means, the controlling means including standby mode executing means for functioning during an imaging standby of said image forming device; image fixing mode executing means for functioning during an imaging operation of said image forming device; and shift mode executing means for functioning, if necessary, only at the initial start of the imaging operation of said image forming device, wherein said standby mode executing means includes:

first comparing means for comparing a determined standby surface temperature $X_o$ of said first roll and the temperature X of said first roll;

second comparing means for comparing the determined standby surface temperature $Y_o$ of said second roll and the temperature Y of said second roll;

first roll control means for driving said first heating means on the basis of the result of comparison of said first comparing means; and second roll control means for driving said second heating means on the basis of the result of comparison of said second comparing means, wherein said image fixing mode executing means includes:

computation means for computing a target surface temperature y required for said second roll to reproduce a predetermined fixing property from the temperature X of said first roll;

computed temperature comparing means for comparing said target surface temperature y and the temperature Y of said second roll; and fixing time drive means for driving said first heating means or said second heating means on the basis of the result of comparison, which is executed by said computed temperature comparing means, and wherein said shift mode executing means includes:

said first comparing means;

said second comparing means; and shifting time drive means for driving said first heating means or said second heating means on the basis of the results of comparison between said first comparing means and second comparing means.

20. A temperature control method for a fixing apparatus including a first roll having first heating means, and a second roll arranged to abut against said first roll and having second heating means, for thermally fixing a toner image onto a recording sheet fed from an image forming device, the method comprising a diagnosis mode to be executed in the imaging operation of said image forming device, said diagnosis mode comprising:

computing a lowest surface temperature $y_L$ required of said second roll from a measured temperature X of said first roll;

a lowest temperature comparing step of comparing said lowest surface temperature $y_L$ and a measured temperature $Y_L$ of said second roll; and a self-diagnosis step of diagnosis the capability of fixing on the basis of the result of comparison.

21. A temperature control method for a fixing apparatus according to claim 20, wherein the lowest temperature computing step includes the substep of computing in accordance with the fixing deciding formula:

$$y_L = AX + C.$$

wherein:

A is a coefficient indicating the ratio of efficiencies for said first roll and said second roll to contribute to the fixing of said toner image;

X is a measured temperature of said first roll; and

C is a coefficient indicating the minimum fixing property of said toner image.

22. A fixing apparatus for thermally fixing a toner image onto a recording sheet fed from an image forming device, comprising:

a first roll having first heating means;

a second roll having second heating means;

first temperature detecting means for detecting a surface temperature X of said first roll;

second temperature detecting means for detecting a surface temperature Y of said second roll; and means for controlling said first heating means and said second heating means, further including diagnosis mode executing means for diagnosing the capability of executing said fixing operation, said diagnosis mode executing means including:

computation means for computing a lowest surface temperature $y_L$ required of said second roll to reproduce a predetermined fixing property from the temperature X of said first roll;

lowest temperature comparing means for comparing said lowest surface temperature $y_L$ and the temperature of Y of said second roll; and self-diagnosis means for deciding the capability of the fixing operation on the basis of the result of comparison.

23. A temperature control method for a fixing apparatus including a first roll having first heating means, and a second roll opposed to the first roll and having second heating means, for thermally fixing a toner image onto a recording sheet, the method comprising the steps of:

computing a target surface temperature y for the second roll from a measured temperature of the first roll;

comparing the target surface temperature y and a measured temperature of the second roll; and driving the first heating means or the second heating means on the basis of a result of the comparing step.

24. A fixing apparatus for thermally fixing a toner image onto a recording sheet, comprising:

a first roll having first heating means;

a second roll having second heating means;

first temperature detecting means for detecting a surface temperature X of the first roll;

second temperature detecting means for detecting a surface temperature Y of the second roll;

means for controlling the first heating means and the second heating means, the controlling means including means for computing a target surface temperature y for the second roll from the temperature X of the first roll, comparing means for comparing the target surface temperature y and the temperature Y of the second roll; and means for driving the first heating means or the second heating means on the basis of a result of the comparing means.

25. A temperature control method for a fixing apparatus including a first roll having first heating means, and a second roll opposed to the first roll and having second heating means, for thermally fixing a toner image onto a recording sheet, the method comprising the steps of:

a first comparing step of comparing a determined standby surface temperature $X_o$ of the first roll and a measured temperature of the first roll;

a second comparing step of comparing a determined standby surface temperature $Y_o$ of the second roll and a measured temperature of the second roll;

driving the first heating means on the basis of the result of comparison of the first comparing step;

driving the second heating means on the basis of the result of comparison of the second comparing step;

computing a target surface temperature y required for the second roll to reproduce a predetermined fixing property from a measured temperature of the first roll;

comparing the target surface temperature y and a measured temperature of the second roll; and driving the first heating means or the second heating means on a basis of the result of comparing step.

26. A fixing apparatus for thermally fixing a toner image onto a recording sheet, comprising:

a first roll having first heating means;

a second roll having second heating means;

first temperature detecting means for detecting a surface temperature X of the first roll;

second temperature detecting means for detecting a surface temperature Y of the second roll; and control means for controlling the first heating means and the second heating means, the controlling means including first comparing means for comparing a determined standby surface temperature $X_o$ of the first roll and the measured temperature of the first roll, second comparing means for comparing a determined standby surface temperature $Y_o$ of the second roll and the temperature of the second roll, means for driving the first heating means on the basis of a result of the first comparing means, means for driving the second heating means on the basis of a result of the second comparing means, means for computing a target surface temperature y for the second roll from the temperature X of the first roll, comparing means for comparing the target surface temperature y and the temperature Y of the second roll; and means for driving the first heating means or the second heating means on the basis of a result of the comparing means.

27. A temperature control method for a fixing apparatus including a first roll having first heating means, and a second roll opposed to the first roll and having second heating means, for thermally fixing a toner image onto a recording sheet, the method comprising the steps of:

a first comparing step of comparing a determined standby surface temperature $X_o$ of the first roll and a measured temperature of X of the first roll;

a second comparing step of comparing a determined standby surface temperature $Y_o$ of the second roll and a measured temperature of the second roll;

driving the first heating means on the basis of a result of the first comparing step;

driving the second heating means on the basis of a result of the second comparing step;

computing a target surface temperature y required for the second roll to reproduce a predetermined fixing property from a measured temperature of the first roll;

a computed temperature comparing step of comparing the target surface temperature y and a measured temperature of the second roll;

a fixing time control step of driving the first heating means or the second heating means on the basis of the result of comparison of the computed temperature comparing step; and driving the first heating means or the second heating means on the basis of the results of comparison of the first comparing step and the second comparing step.

28. A fixing apparatus for thermally fixing a toner image onto a recording sheet, comprising:

a first roll having first heating means;

a second roll having second heating means;

first temperature detecting means for detecting a surface temperature X of the first roll;

second temperature detecting means for detecting a surface temperature Y of the second roll;

means for controlling the first heating means and the second heating means, first comparing means for comparing a determined standby surface temperature Xo of the first roll and the temperature of the first roll;

second comparing means for comparing the determined standby surface temperature Yo of the second roll and the temperature of the second roll;

means for driving the first heating means on the basis of a result of the first comparing means; and means for driving the second heating means on the basis of a result of the second comparing means;

computation means for computing a target surface temperature y required for the second roll to reproduce a predetermined fixing property from the temperature of the first roll;

computed temperature comparing means for comparing the target surface temperature y and the temperature of the second roll;

means for driving the first heating means or the second heating means on the basis of a result of comparison of the computed temperature comparing means; and means for driving the first heating means or the second heating means on the basis of the results of comparison between the first comparing means and second comparing means.

29. A temperature control method for a fixing apparatus including a first roll having first heating means, and a second roll opposed to the first roll and having second heating means, for thermally fixing a toner image onto a recording sheet, the method comprising the steps of:

computing a lowest surface temperature $y_L$ for the second roll from a measured temperature X of the first roll;

comparing the lowest surface temperature $y_L$ and a measured temperature of the second roll; and diagnosing the capability of fixing on the basis of the result of comparison.

* * * * *